US012416251B2

(12) United States Patent
Lorenzon et al.

(10) Patent No.: US 12,416,251 B2
(45) Date of Patent: Sep. 16, 2025

(54) ACTUATING MECHANISM FOR A SWITCHABLE ROCKER ARM

(71) Applicant: Eaton Intelligent Power Limited, Dublin (IE)

(72) Inventors: Alessio Lorenzon, Avigliana (IT); Egidio Canzoniere, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/899,995

(22) Filed: Sep. 27, 2024

(65) Prior Publication Data

US 2025/0020073 A1 Jan. 16, 2025

Related U.S. Application Data

(63) Continuation of application No. PCT/EP2023/025188, filed on Apr. 21, 2023.

(60) Provisional application No. 63/333,806, filed on Apr. 22, 2022.

(51) Int. Cl.
*F01L 1/18* (2006.01)

(52) U.S. Cl.
CPC ..... *F01L 1/185* (2013.01); *F01L 2001/186* (2013.01)

(58) Field of Classification Search
CPC .. F01L 1/185; F01L 2001/186; F01L 13/0005
See application file for complete search history.

(56) References Cited

U.S. PATENT DOCUMENTS

| | | | | |
|---|---|---|---|---|
| 5,529,033 | A | 6/1996 | Hampton | |
| 6,499,451 | B1 | 12/2002 | Hendriksma | |
| 2004/0035381 | A1 | 2/2004 | Burch | |
| 2020/0271024 | A1* | 8/2020 | Stretch | F01L 1/185 |

FOREIGN PATENT DOCUMENTS

EP 0767296 A1 4/1997

OTHER PUBLICATIONS

International search report and Written Opinion received for PCT Application No. PCT/EP2023/25188, 15 pages, Nov. 27, 2023.

* cited by examiner

*Primary Examiner* — Ngoc T Nguyen
(74) *Attorney, Agent, or Firm* — Baker Botts L.L.P.

(57) ABSTRACT

An actuation mechanism for selective switching of a valve-train switching mechanism by a linear actuator mechanism includes an actuator arm having a pin contact surface for engaging an actuator pin of a linear actuator mechanism, a switching arm, and a lever axle pivotally coupling the actuator arm and the switching arm and rotatable about a lever axis, wherein the actuation mechanism is configured to rotate about the lever axis based on a selective extension of the actuator pin, wherein the switching arm is configured to selectively act on the valvetrain switching mechanism based on the rotation of the actuation mechanism; and wherein multiple interface positions on the pin contact surface of the actuator arm are each configured to cooperatively engage with the actuator pin at an orthogonal angle to the axis of linear motion of the actuator pin.

18 Claims, 27 Drawing Sheets

22

ACTUATING MECHANISM FOR A SWITCHABLE ROCKER ARM

PRIORITY

This application is a continuation under 35 U.S.C. § 365(c) of International Patent Application No. PCT/EP2023/025188, filed on 21 Apr. 2023, which claims the benefit under 35 U.S.C. § 119(e) of U.S. Application No. 63/333,806, filed 22 Apr. 2022, all of which are incorporated herein by reference.

TECHNICAL FIELD

The present disclosure relates generally to valvetrain mechanisms for engines, and more particularly to mechanisms, assemblies, arrangements, and methods relating to rocker arm assemblies and roller finger followers.

BACKGROUND

Roller Finger Followers ("RFF") can be comprised of different parts assembled into a composite device. A Switching Roller Finger Follower ("SRFF") can also be formed as a composite, and may permit mode switching to enable particular functionality.

For instance, SRFF may be used for enabling: variable valve lift ("VVL") or variable valve actuation ("VVA") methodologies; altered valve timing(s), such as early, late, or zero valve opening or closing; cylinder deactivation ("CDA") methodologies; late intake valve opening ("LIVO"), early exhaust valve closing ("EIVC"), engine braking ("EB"), and internal gas recirculation ("IGR"), as some non-limiting examples.

The description provided herein is for the purpose of generally presenting the context of the disclosure. Work of the presently named inventors, to the extent it is described in this section, as well as aspects of the description that cannot otherwise qualify as prior art at the time of filing, are neither expressly nor impliedly admitted as prior art against the present disclosure.

SUMMARY OF PARTICULAR EMBODIMENTS

In particular embodiments, an actuation mechanism is disclosed for selective switching of a valvetrain switching mechanism by a linear actuator mechanism, the actuation mechanism comprising an actuator arm comprising a first end and a second end opposite the first end, the second end of the actuator arm comprising a pin contact surface configured to cooperatively engage with a selectively and linearly extendable actuator pin of the actuator mechanism; a switching arm comprising a first end and a second end opposite the first end; and a lever axle pivotally coupling the actuator arm and the switching arm at the first end of each of the actuator arm and the switching arm, the lever axle rotatable about a lever axis; wherein the actuation mechanism is configured to rotate about the lever axis in a first direction based on an extension of the actuator pin along an axis of linear motion of the actuator pin, and rotate about the lever axis in a second direction opposite to the first direction based on a retraction of the actuator pin along the axis of linear motion of the actuator pin; wherein the second end of the switching arm is configured to selectively act on a switching element of the valvetrain switching mechanism based on the rotation of the actuation mechanism; and wherein, based on the rotation of the actuation mechanism about the lever axis, a plurality of interface positions disposed on the pin contact surface of the actuator arm are each configured to cooperatively engage with the actuator pin at an orthogonal angle to the axis of linear motion of the actuator pin.

In particular embodiments, which may combine the features of some or all of the above embodiments, the pin contact surface comprises a curved surface having a curvature along a contact trajectory of the pin contact surface with the actuator pin, the plurality of interface positions being disposed along the contact trajectory. In particular embodiments, which may combine the features of some or all of the above embodiments, the actuation mechanism comprises one or more second switching arms, each second switching arm comprising a first end and a second end, wherein the lever axle further pivotally couples the respective first end of each second switching arm to be rotatable about the lever axis, and wherein the respective second end of each second switching arm is configured to selectively act on a respective second switching element of the valvetrain switching mechanism based on the rotation of the actuation mechanism.

In particular embodiments, which may combine the features of some or all of the above embodiments, the actuation mechanism further comprises a biasing member configured to bias rotation of the actuation mechanism in the first direction or the second direction. In particular embodiments, which may combine the features of some or all of the above embodiments, the actuation mechanism further comprises a supporting member coaxially provided with the lever axle and configured to secure the actuation mechanism to an external structure. In particular embodiments, which may combine the features of some or all of the above embodiments, the actuation mechanism further comprises an over-travel limiter coaxially provided with the lever axle and rotatably coupled with the lever axle, the over-travel limiter structured to constrain a rotational travel limit of the switching arm. In particular embodiments, which may combine the features of some or all of the above embodiments, the over-travel limiter is structured to selectively contact the supporting member to prevent rotation of the switching arm.

In particular embodiments, an actuation system is disclosed for a switchable valvetrain assembly, the actuation system comprising a linear actuator comprising a selectively extendable actuator pin; a rocker arm of the switchable valvtetrain assembly, the rocker arm further comprising a switchable latching pin; and an actuation mechanism comprising an actuator arm comprising a first end and a second end opposite the first end, the second end of the actuator arm comprising a pin contact surface configured to cooperatively engage with the actuator pin; a switching arm comprising a first end and a second end opposite the first end; and a lever axle pivotally coupling the actuator arm and the switching arm at the first end of each of the actuator arm and the switching arm, the lever axle rotatable about a lever axis; wherein the actuation mechanism is configured to rotate about the lever axis between a first lever position and a second lever position based on a selective extension of the actuator pin along an axis of linear motion of the actuator pin; wherein the second end of the switching arm is configured to selectively switch the switchable latching pin of the rocker arm based on the position of the actuation mechanism; and wherein, based on the rotation of the actuation mechanism about the lever axis, a plurality of interface positions disposed on the pin contact surface of the actuator arm are each configured to cooperatively engage with the actuator pin at an orthogonal angle to the axis of linear motion of the actuator pin.

In particular embodiments, which may combine the features of some or all of the above embodiments, the pin contact surface comprises a curved surface having a curvature along a contact trajectory of the pin contact surface with the actuator pin, the plurality of interface positions disposed along the contact trajectory. In particular embodiments, which may combine the features of some or all of the above embodiments, the actuation system further comprises one or more second switching arms, each second switching arm comprising a first end and a second end, wherein the lever axle further pivotally couples the respective first end of each second switching arm to be rotatable about the lever axis, and wherein the respective second end of each second switching arm is configured to selectively switch a respective second switchable latching pin based on the rotation of the actuation mechanism.

In particular embodiments, which may combine the features of some or all of the above embodiments, the actuation system further comprises a biasing member configured to bias rotation of the actuation mechanism toward the first lever position or the second lever position. In particular embodiments, which may combine the features of some or all of the above embodiments, the actuation system further comprises a supporting member coaxially provided with the lever axle and configured to secure the actuation mechanism to an external structure. In particular embodiments, which may combine the features of some or all of the above embodiments, the actuation system further comprises an over-travel limiter coaxially provided with the lever axle and rotatably coupled with the lever axle, the over-travel limiter structured to constrain a rotational travel limit of the switching arm. In particular embodiments, which may combine the features of some or all of the above embodiments, the over-travel limiter is structured to selectively contact the supporting member to prevent rotation of the switching arm.

In particular embodiments, which may combine the features of some or all of the above embodiments, an actuator arm distance and a switching arm distance being configured based on at least a force rating and a stroke length rating of the actuator pin, such that the actuator pin is enabled to selectively act on the actuation mechanism and correspondingly selectively switch the switchable latching pin of the rocker arm; wherein the actuator arm distance is defined as a shortest distance between the axis of linear motion of the actuator pin and the lever axis, and wherein a switching arm distance is defined as a shortest distance between a longitudinal axis of the switchable latching pin and the lever axis.

In particular embodiments, which may combine the features of some or all of the above embodiments, the actuator arm distance and the switching arm distance being configured further based on one or more latching pin parameters of the switchable latching pin. In particular embodiments, which may combine the features of some or all of the above embodiments, a biasing member of the actuation mechanism is configured based on at least the actuator arm distance and the switching arm distance of the actuation mechanism.

In particular embodiments, a method is disclosed of selectively switching a latching pin of a rocker arm by a linear actuator mechanism, the method comprising selectively extending an actuator pin of the actuator mechanism between a first actuator pin position and a second actuator pin position along an axis of linear motion, the actuator pin engaging a pin contact surface of an actuation mechanism, the actuation mechanism comprising an actuator arm and a switching arm, the pin contact surface provided at an end of the actuator arm; operating, based on selectively extending the actuator pin, the actuator arm to selectively rotate the actuation mechanism about a lever axis between a first lever position and a second lever position; and operating, based on selectively rotating the actuation mechanism and based on pivotal coupling of the actuator arm and a switching arm by a lever axle of the actuation mechanism, the switching arm to selectively act on the latching pin of the rocker arm, wherein, based on the rotation of the actuation mechanism between the first and second lever positions, a plurality of interface positions disposed on the pin contact surface are each configured to cooperatively engage with the actuator pin at an orthogonal angle to the axis of linear motion of the actuator pin.

In particular embodiments, which may combine the features of some or all of the above embodiments, the pin contact surface comprises a curved surface having a curvature along a contact trajectory of the pin contact surface with the actuator pin, the plurality of interface positions disposed along the contact trajectory. In particular embodiments, which may combine the features of some or all of the above embodiments, the method further comprises configuring an actuator arm distance and a switching arm distance based on at least a force rating and a stroke length rating of the actuator pin, such that the actuator pin is enabled to selectively act on the actuation mechanism and correspondingly selectively switch the latching pin of the rocker arm, wherein the actuator arm distance is defined as a shortest distance between the axis of linear motion of the actuator pin and the lever axis of the actuation mechanism, and wherein a switching arm distance is defined as a shortest distance between a longitudinal axis of the switchable latching pin and the lever axis.

In particular embodiments, a coupler is disclosed for securing a lash adjuster to a rocker arm assembly, the coupler comprising a base comprising an aperture configured to receive the lash adjuster; and a plurality of arms extending from the base, each of the plurality of arms having a first end and a second end opposite the first end, wherein the first end of each of the plurality of arms is coupled to the base at an outer perimeter of the base, wherein the second end of each of the plurality of arms is angled toward an axis orthogonal to and passing through the base and configured to engage with the rocker arm assembly to secure the coupler to the rocker arm assembly, wherein a pair of the plurality of arms comprises a spacing configured to enable the pair of the plurality of arms to surround or fork around one or more projecting structures of the rocker arm assembly, and wherein the second end of each of the plurality of arms further comprises a tab, the tab comprising a section of the second end projecting toward the rocker arm assembly when the coupler is assembled with the rocker arm assembly, the tab configured to engage with an edge or a corresponding receiving feature of the rocker arm assembly.

In particular embodiments, which may combine the features of some or all of the above embodiments, the one or more projecting structures of the rocker arm assembly comprise a rocker arm boss. In particular embodiments, which may combine the features of some or all of the above embodiments, the pair of the plurality of arms are coupled to each other at a location away from the respective first ends of the pair of the plurality of arms.

In particular embodiments, which may combine the features of some or all of the above embodiments, one or more arms of the plurality of arms of the coupler are configured to be temporarily deformed for assembling the coupler with the rocker arm assembly, the temporary deformation acting to increase an angle made by each temporarily deformed arm with an axis orthogonal to and passing through the base. In particular embodiments, which may combine the features of some or all of the above embodiments, the second end of each of the plurality of arms further comprises one or more indents, each indent comprising a projection pointed toward the base of the coupler, the one or more indents configured to couple with or grip a receiving surface or a corresponding feature of the rocker arm assembly.

In particular embodiments, which may combine the features of some or all of the above embodiments, the coupler being made of a resilient material such that the plurality of arms are restored to an original or undeformed state based on disassembly of the coupler from the rocker arm assembly. In particular embodiments, which may combine the features of some or all of the above embodiments, the coupler further comprises a plurality of pairs of the plurality of arms, each pair of the plurality of pairs corresponding to a respective rocker arm boss spacing. In particular embodiments, which may combine the features of some or all of the above embodiments, each of the plurality of arms is coupled to the base at a curved corner, a curvature of the curved corner facilitating reduced stress concentration at the curved corner. In particular embodiments, which may combine the features of some or all of the above embodiments, the curved corner extends past the base in an opposite direction to a direction of the plurality of arms extending from the base.

In particular embodiments, which may combine the features of some or all of the above embodiments, the curved corner of each arm extends past the respective arm in an opposite direction to the axis orthogonal to and passing through the base.

In particular embodiments, a valvetrain assembly is disclosed comprising a rocker arm assembly; a lash adjuster; and a coupler securing the lash adjuster to the rocker arm assembly, the coupler further comprising a base comprising an aperture configured to receive the lash adjuster; and a plurality of arms extending from the base, each of the plurality of arms having a first end and a second end opposite the first end, wherein the first end of each of the plurality of arms is coupled to the base at an outer perimeter of the base, wherein the second end of each of the plurality of arms is angled toward an axis orthogonal to and passing through the base and configured to engage with the rocker arm assembly to secure the coupler to the rocker arm assembly, wherein pairs of the plurality of arms each comprise a respective spacing configured to enable each respective pair of the plurality of arms to surround or fork around one or more respective projecting structures of the rocker arm assembly, and wherein the second end of each of the plurality of arms further comprises a tab, the tab comprising a section of the second end projecting toward the rocker arm assembly when the coupler is assembled with the rocker arm assembly, the tab configured to engage with an edge or a corresponding receiving feature of the rocker arm assembly.

In particular embodiments, which may combine the features of some or all of the above embodiments, the one or more respective projecting structures of the rocker arm assembly comprise a respective rocker arm boss corresponding to each pair of the plurality of arms. In particular embodiments, which may combine the features of some or all of the above embodiments, the second end of each of the plurality of arms further comprising one or more indents, each indent comprising a projection pointed toward the base of the coupler, the one or more indents configured to grip or couple with a surface or a feature of the rocker arm assembly. In particular embodiments, which may combine the features of some or all of the above embodiments, each of the plurality of arms is coupled to the base at a curved corner, a curvature of the curved corner facilitating reduced stress concentration at the curved corner. In particular embodiments, which may combine the features of some or all of the above embodiments, the curved corner extends past the base in an opposite direction to a direction of the plurality of arms extending from the base. In particular embodiments, which may combine the features of some or all of the above embodiments, the curved corner of each arm extends past the respective arm in an opposite direction to the axis orthogonal to and passing through the base.

In particular embodiments, a method is disclosed of using a coupler for securing a lash adjuster to a rocker arm assembly, the method comprising positioning the coupler adjacent to the rocker arm for assembly, such that a base of the coupler comprising an aperture to receive the lash adjuster is aligned with and longitudinally offset from a corresponding interface of the rocker arm assembly; temporarily deforming one or more arms of a plurality of arms of the coupler to assemble the coupler with the rocker arm assembly, each of the plurality of arms extending from the base and having a first end coupled to the base and a second end opposite the first end, the temporary deformation acting to increase an angle made by each temporarily deformed arm with an axis orthogonal to and passing through the base; slidably translating the coupler along the rocker arm assembly, such that pairs of the plurality of arms surround or fork around one or more respective projecting structures of the rocker arm assembly, and such that one or more tabs at respective second ends of the plurality of arms grip or engage with an edge or a corresponding feature of the rocker arm assembly; and inserting the lash adjuster past the aperture of the coupler configured to receive the lash adjuster and into the corresponding interface of the rocker arm assembly.

In particular embodiments, which may combine the features of some or all of the above embodiments, the method further comprises coupling one or more indents disposed at the respective second ends of the plurality of arms of the coupler with a respective receiving surface or a respective corresponding feature of the rocker arm assembly.

In particular embodiments, a rocker arm assembly is disclosed comprising a latching pin body comprising a lash adjuster socket; and an outer arm comprising: two endwalls disposed along a longer dimension of the outer arm; and a base wall coupling the two endwalls, the base wall comprising a lash adjuster aperture at a first end of the longer dimension of the outer arm, wherein the latching pin body is disposed between the two endwalls at the first end of the longer dimension of the outer arm, wherein a perimeter edge of the lash adjuster socket of the latching pin body is disposed adjacent to an edge of the lash adjuster aperture of the outer arm, and wherein the perimeter edge of the lash adjuster socket of the latching pin body is coupled to the edge of the lash adjuster aperture of the outer arm by a welded connection.

In particular embodiments, which may combine the features of some or all of the above embodiments, the welded connection is continuous. In particular embodiments, which may combine the features of some or all of the above embodiments, the two endwalls being parallel to each other. In particular embodiments, which may combine the features of some or all of the above embodiments, the lash adjuster aperture of the outer arm forming a circular shape. In particular embodiments, which may combine the features of some or all of the above embodiments, the welded connection being a butt-welded connection. In particular embodiments, which may combine the features of some or all of the above embodiments, the lash adjuster socket of the latching pin body comprising an ogive shape.

In particular embodiments, a rocker arm assembly is disclosed comprising an outer arm comprising two endwalls disposed along a longer dimension of the outer arm; and a base wall coupling the two endwalls, the base wall comprising a lash adjuster aperture at a first end of the longer dimension of the outer arm; an inner arm pivotally coupled to the outer arm; a latching pin body comprising a lash adjuster socket and a latching pin, the latching pin movable between a locked and an unlocked position; a biasing member configured to provide a biasing action on the inner arm relative to the outer arm; one or more rollers coupled to one or more roller axles; and a lash adjuster coupled to the lash adjuster socket; wherein the latching pin body is disposed between the two endwalls at the first end of the longer dimension of the outer arm, wherein a perimeter edge of the lash adjuster socket of the latching pin body is disposed adjacent to an edge of the lash adjuster aperture of the outer arm, and wherein the perimeter edge of the lash adjuster socket of the latching pin body is coupled to the edge of the lash adjuster aperture of the outer arm by a welded connection.

In particular embodiments, which may combine the features of some or all of the above embodiments, the welded connection is continuous. In particular embodiments, which may combine the features of some or all of the above embodiments, the two endwalls being parallel to each other. In particular embodiments, which may combine the features of some or all of the above embodiments, the lash adjuster aperture of the outer arm forming a circular shape. In particular embodiments, which may combine the features of some or all of the above embodiments, the welded connection being a butt-welded connection. In particular embodiments, which may combine the features of some or all of the above embodiments, the lash adjuster socket of the latching pin body comprising an ogive shape.

In particular embodiments, a method is disclosed of manufacturing a rocker arm assembly, the method comprising: providing an outer arm, the outer arm comprising two endwalls disposed along a longer dimension of the outer arm, the outer arm further comprising a lash adjuster aperture at a first end of the longer dimension; providing a latching pin body between the two endwalls at the first end of the longer dimension of the outer arm, the latching pin body comprising a lash adjuster socket; aligning a perimeter edge of the lash adjuster socket of the latching pin body adjacent to an edge of the lash adjuster aperture of the outer arm; and welding the perimeter edge of the lash adjuster socket with the edge of the lash adjuster aperture of the outer arm.

In particular embodiments of the method, which may combine the features of some or all of the above embodiments, the perimeter edge of the lash adjuster socket is welded with the edge of the lash adjuster aperture of the outer arm in a single continuous welding pass. In particular embodiments, which may combine the features of some or all of the above embodiments, the welding comprises butt welding. In particular embodiments, which may combine the features of some or all of the above embodiments, the two endwalls are parallel to each other. In particular embodiments, which may combine the features of some or all of the above embodiments, the welding is performed along a circular path. In particular embodiments, which may combine the features of some or all of the above embodiments, the welding is performed along a curvilinear path. In particular embodiments, which may combine the features of some or all of the above embodiments, the welding comprises laser welding. In particular embodiments, which may combine the features of some or all of the above embodiments, the lash adjuster socket of the latching pin body comprises an ogive shape. In particular embodiments, which may combine the features of some or all of the above embodiments, the welding is performed along a combination of linear and curvilinear paths.

In particular embodiments, which may combine the features of some or all of the above embodiments, the perimeter edge of the lash adjuster socket is welded with the edge of the lash adjuster aperture of the outer arm using a plurality of segments.

BRIEF DESCRIPTION OF THE DRAWINGS

The present invention will be described in greater detail below based on the exemplary figures. The invention is not limited to the exemplary embodiments. Other features and advantages of various embodiments of the present invention will become apparent by reading the following detailed description with reference to the attached drawings which illustrate the following.

Figure 1A:
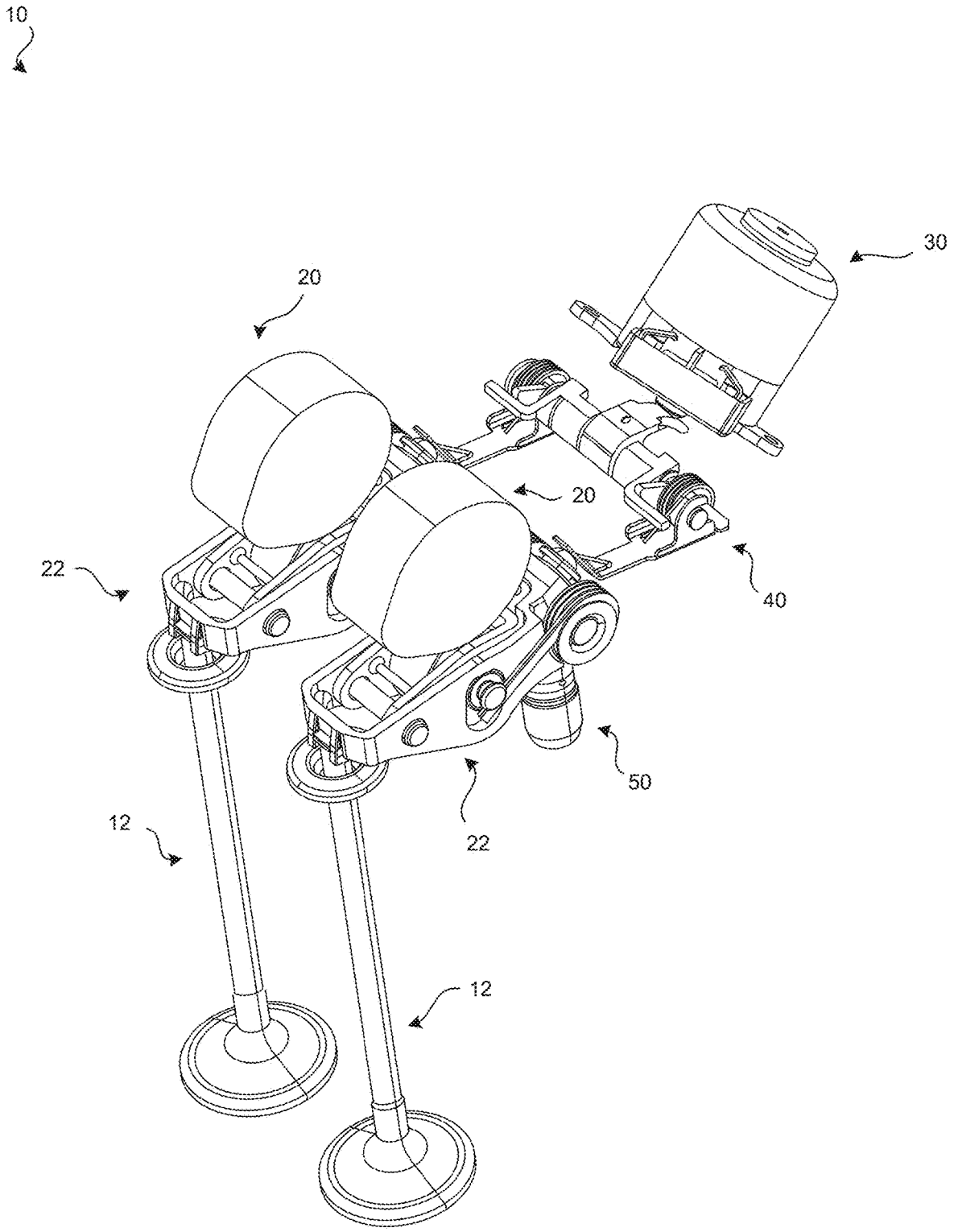
FIG. 1A illustrates a schematic perspective view of a valvetrain assembly, according to particular embodiments.

It should be noted that figures provided may be illustrated schematically rather than literally or precisely; components and aspects of the figures may also not necessarily be to scale. Moreover, while like reference numerals may designate corresponding parts throughout the different views in many cases, like parts may not always be provided with like reference numerals in each view.

DESCRIPTION OF EXAMPLE EMBODIMENTS

In accordance with various embodiments of the present disclosure, various mechanisms, assemblies, arrangements, and methods of operation, manufacture, and/or assembly of engine valvetrains, rocker arm assemblies, and/or related subsystems are disclosed herein. For clarity, not all features of each actual implementation or embodiment may be described in this specification.

Additionally, some aspects and features may be described at a high level. Further, features and aspects that are disclosed, illustrated, and/or apparently otherwise contemplated in certain specific configurations are fully contemplated to be mixed or combined to produce any and all resulting configurations using features and aspects from any embodiments and/or configurations considered herein. Features, limitations, and/or other descriptions that may follow or be introduced with respective to particular figures may separately or additionally apply and be contemplated with respect to other embodiments, and/or descriptions relating to other figures, whether individually or in combination. Thus, modifications, variations, adaptations, and/or combinations of features and aspects may be made that result in embodiments that are fully contemplated to fall within the scope of this disclosure.

With reference to the figures, FIGS. 1A-1D illustrate schematic views of a valvetrain assembly, and a rocker arm assembly, according to particular embodiments, as non-limiting examples to describe particular features and aspects herein. FIG. 1A illustrates a schematic perspective view of a valvetrain assembly, according to particular embodiments. In particular embodiments, one or more cams 20 of an engine valvetrain assembly may be used to provide timing and perform controlled opening and closing of one or more valves 12. In particular embodiments, one or more rocker arm assemblies 22 may provide selective transmission and/or tailoring of motion from cams 20 for operating valves 12. As illustrated in further detail by the non-limiting examples of at least FIGS. 1B-1D, a rocker arm assembly 22 may comprise one or more rollers 250 for following motion of a corresponding cam 20, wherein a roller 250 may be configured to rotate about an axle, such as roller axle 252. In particular embodiments, such a rocker arm assembly 22 comprising one or more rollers 250 may comprise or otherwise qualify as a roller finger follower ("RFF").

Further, in particular embodiments, a roller finger follower may be switchable in one or more respects, and may thereby qualify as a switchable roller finger follower ("SRFF"). For instance, SRFFs may be used for enabling: variable valve lift ("VVL") or variable valve actuation ("VVA") methodologies; altered valve timing(s), such as early, late, or zero valve opening or closing; cylinder deactivation ("CDA") methodologies; late intake valve opening ("LIVO"), early exhaust valve closing ("EIVC"), engine braking ("EB"), and internal gas recirculation ("IGR"), as some non-limiting examples, among multiple individual and/or combinable options.

As illustrated in at least FIG. 1A, in particular embodiments, a switchable rocker arm assembly 22 may be configured to be switchable by an actuator 30. In particular embodiments, an actuator switching lever assembly 40 may be provided to enable selective switching of the valvetrain switching mechanism by actuator 30. Inventive aspects of particular embodiments of actuator switching lever assembly 40, and/or related assemblies, will be further described herein.

As illustrated in at least FIG. 1A, in particular embodiments, a rocker arm assembly 22 may comprise a hydraulic lash adjustment (HLA) assembly 50. According to specific embodiments, a support structure, such as HLA clip 295, may be used to support and/or otherwise constrain HLA 50 in a desired position or orientation. Inventive aspects of particular embodiments of HLA clip 295, and/or related assemblies, will be further described herein.

Figure 1B:
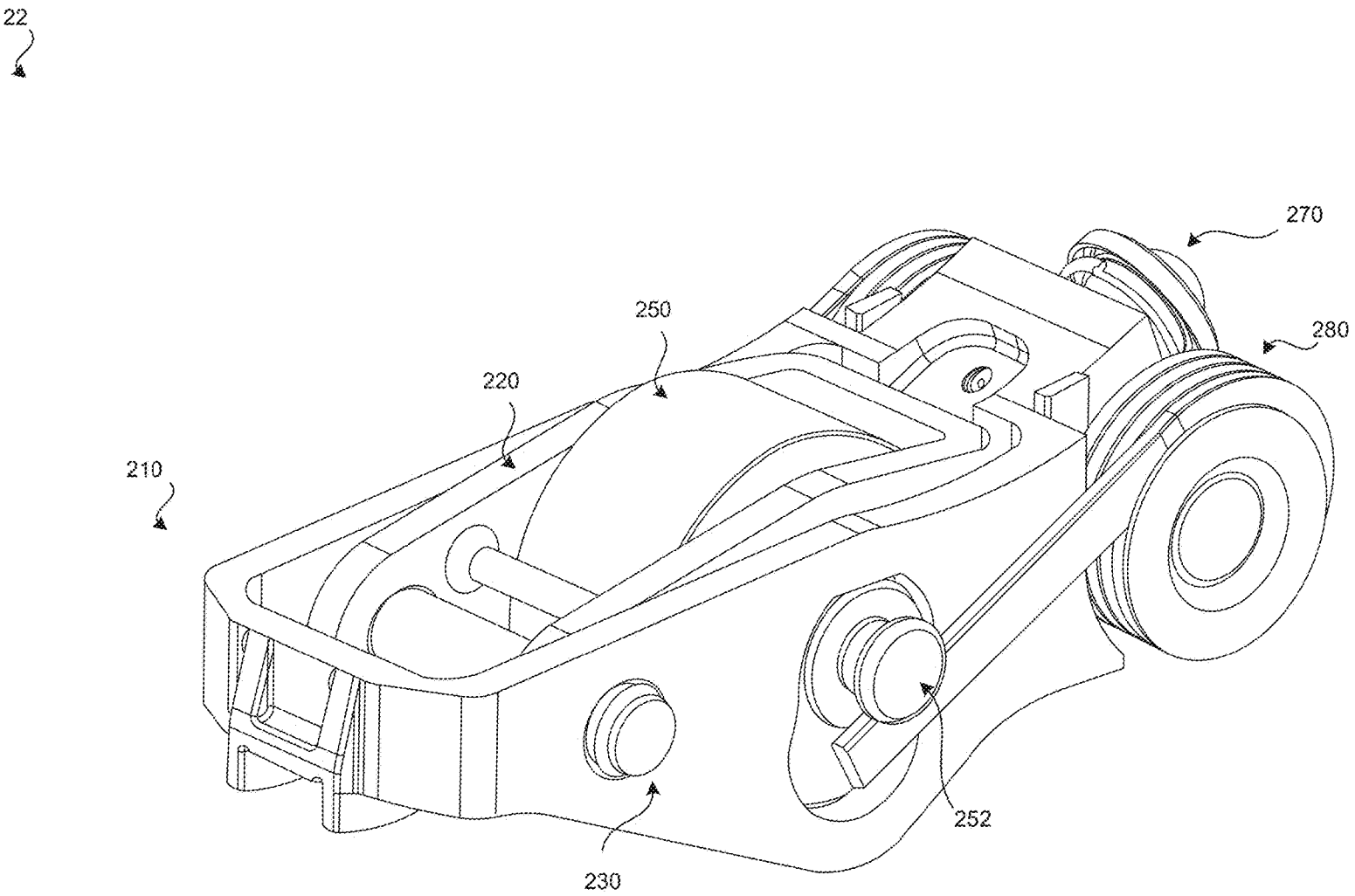
FIG. 1B illustrates a schematic perspective view of a rocker arm assembly, according to particular embodiments.
Figure 1C:
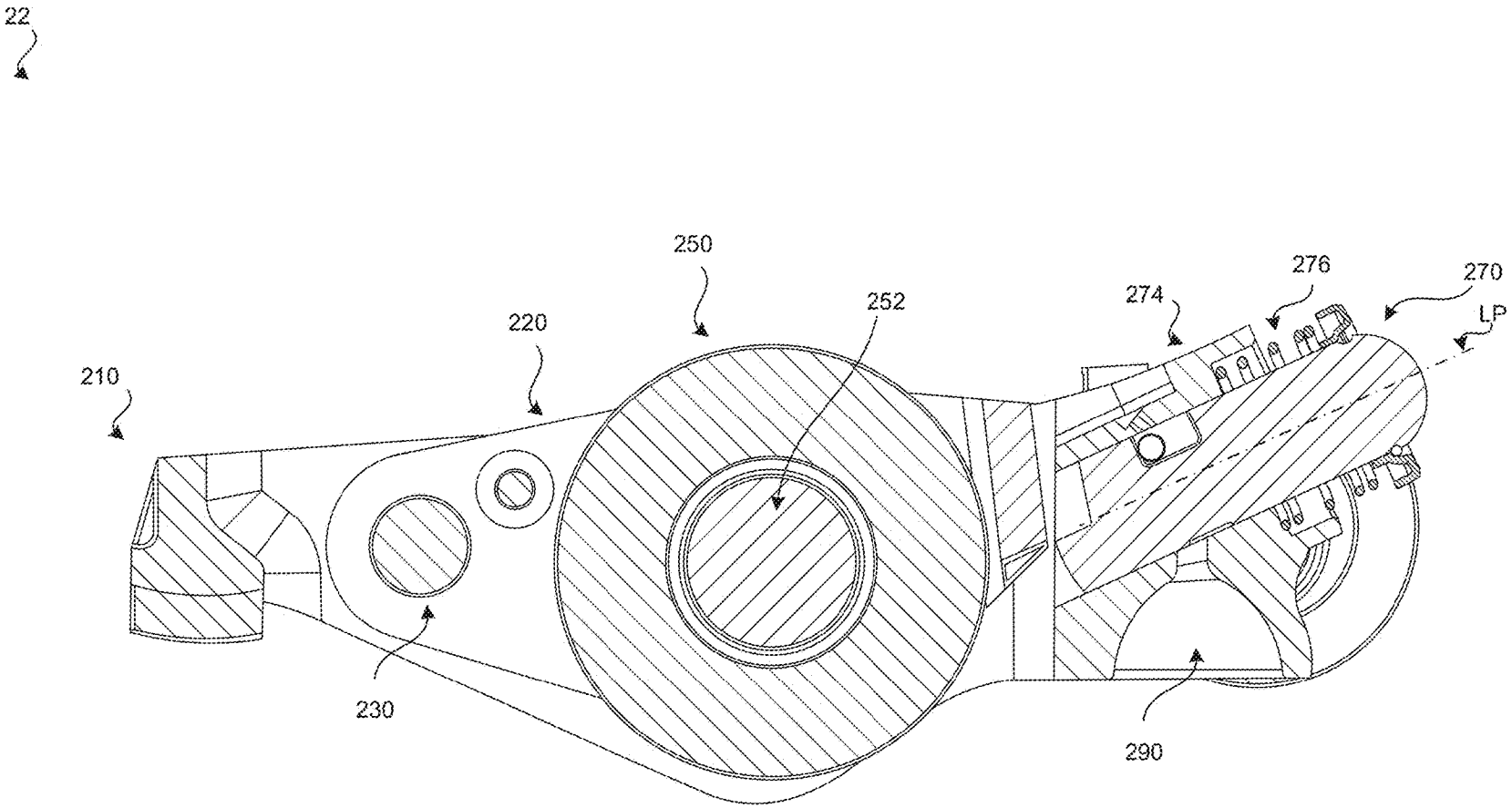
FIG. 1C illustrates a schematic side cross-sectional view of a rocker arm assembly, according to particular embodiments.
Figure 1D:
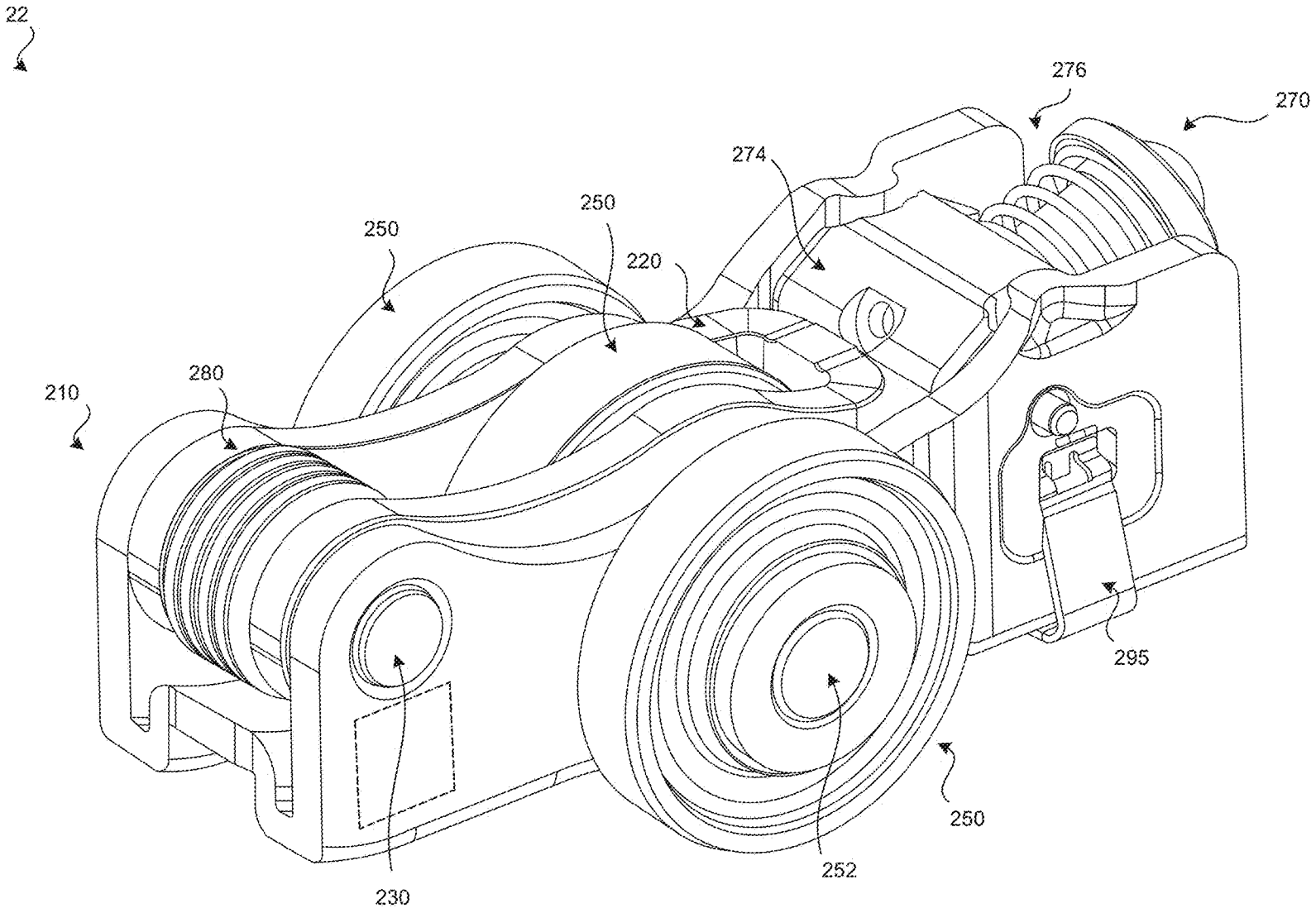
FIG. 1D illustrates a schematic perspective view of a rocker arm assembly, according to particular embodiments.

FIG. 1B illustrates a schematic perspective view of a rocker arm assembly, according to particular embodiments. FIG. 1C illustrates a schematic side cross-sectional view of a rocker arm assembly, according to particular embodiments. FIG. 1D illustrates a schematic perspective view of a rocker arm assembly, according to particular embodiments.

In particular embodiments, for instance as illustrated by the non-limiting examples of FIGS. 1B-1D, a switchable rocker arm assembly 22 may comprise an outer body 210, and an inner body 220. By way of example and not limitation, inner body 220 may be configured to selectively be locked, unlocked, and/or pivoted relative to outer body 210, such as about pivot axle 230. In particular embodiments, a biasing member, such as rocker arm biasing member 280, may be provided to bias the position of inner body 220 relative to outer body 210 in one or more particular orientations. In particular embodiments, as illustrated in FIG. 1C, a selective locking mechanism, such as a latching pin 270, may be provided to enable locking or unlocking pivotal motion of inner body 220 relative to outer body 210. By way of example and not limitation, rocker arm biasing member 280 may comprise a spring.

As a non-limiting example, latching pin 270 may be configured to translate along a latching pin longitudinal axis LP. In particular embodiments, latching pin 270 may be biased toward a particular direction, such as an outward or unlocked position, by a latching pin biasing member 276. By way of example and not limitation, latching pin biasing member 276 may comprise a spring. In particular embodiments, latching pin 270, latching pin biasing member 276, and/or other related components may be housed and/or supported in a latching pin housing structure, such as latching pin body 274. Inventive aspects of particular embodiments and methods relating to latching pin body 275 assembled within and relative to rocker arm assembly 22, and/or related assemblies, will be further described herein.

In particular embodiments, a switchable rocker arm 22 may be configured to selectively or switchably follow a single roller. By way of example and not limitation, FIG. 1B illustrates a switchable rocker arm 22 that may be configured to selectively follow a single cam via roller 250, i.e., to enable or disable the ability of the cam acting on roller 250 to operate or influence a corresponding valve. In particular embodiments, roller 250 may be coupled to inner body 220; a valve (such as valve 12, not shown in every figure) may be coupled to outer body 210. For instance, a disengaged or unlocked position of latching pin 270 (e.g., as illustrated in FIG. 1C) may enable inner body 220 to pivot relative to outer body 210 about pivot axle 230 in response to roller 250 receiving motion or valve lift from a cam, thereby enabling rocker arm 22 to absorb or otherwise prevent transmission of motion from the cam to the valve. Stated differently, rocker arm 22 may enable deactivating the cam by absorbing the cam motion as lost motion, such as by rocker arm biasing member 280. In contrast, in an engaged or locked position of latching pin 270, outer body 210 may be coupled, locked, or otherwise constrained to move together with inner body 220 and thereby transmit a valve lift from a cam acting on roller 250 to a valve. As a non-limiting example, such a rocker arm 22 may be used to enable cylinder deactivation (CDA), wherein a cylinder may be deactivated by selectively operating the latching pin. In particular embodiments, such a rocker arm 22, which may be designed to absorb large displacements, such as large parts or full extents of maximum cam displacement, may require and/or comprise relatively large components to support lost motion absorption of large displacements and/or forces, such as a relatively large rocker arm biasing member 280, as illustrated in FIG. 1B.

In particular embodiments, a switchable rocker arm 22 may be configured to selectively or switchably operating in multiple modes based on multiple rollers 250. By way of example and not limitation, FIG. 1D illustrates a switchable rocker arm 22 that may be configured to selectively engage with a central roller 250 of multiple rollers (three rollers 250 illustrated in the non-limiting example of FIG. 1D). For instance, in particular embodiments, a central roller 250 may engage with a particular lift profile of a corresponding central cam, whereas two outer rollers 250 may engage with different lift profile(s) of corresponding outer cams relative to the central cam. For instance, such an arrangement may enable variable valve lift (VVL) operation corresponding to different cam lift profiles, based on selectively switching latching pin 270. In particular embodiments, such an arrangement may not require lost motion absorption of large displacements and/or forces (relative to, say, a CDA roller arm), and may consequently be provided with relatively smaller components, such as rocker arm biasing member 280 (compare 280 between FIGS. 1B and 1D).

Figure 2A:
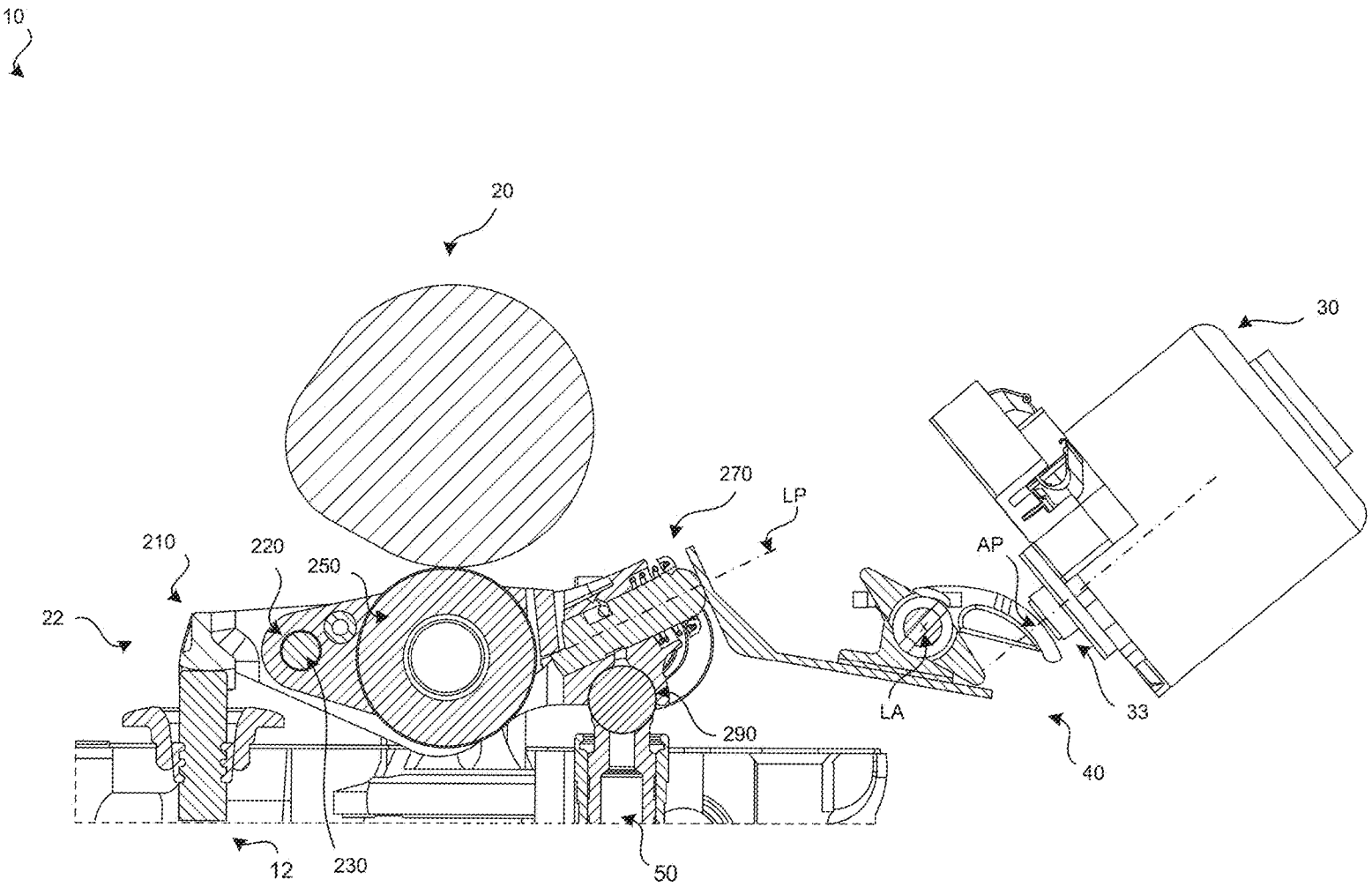
FIG. 2A illustrates a schematic side cross-sectional partial view of a valvetrain assembly, illustrating a rocker arm assembly, an actuator lever assembly, and an actuator switching assembly, according to particular embodiments.
Figure 2B:
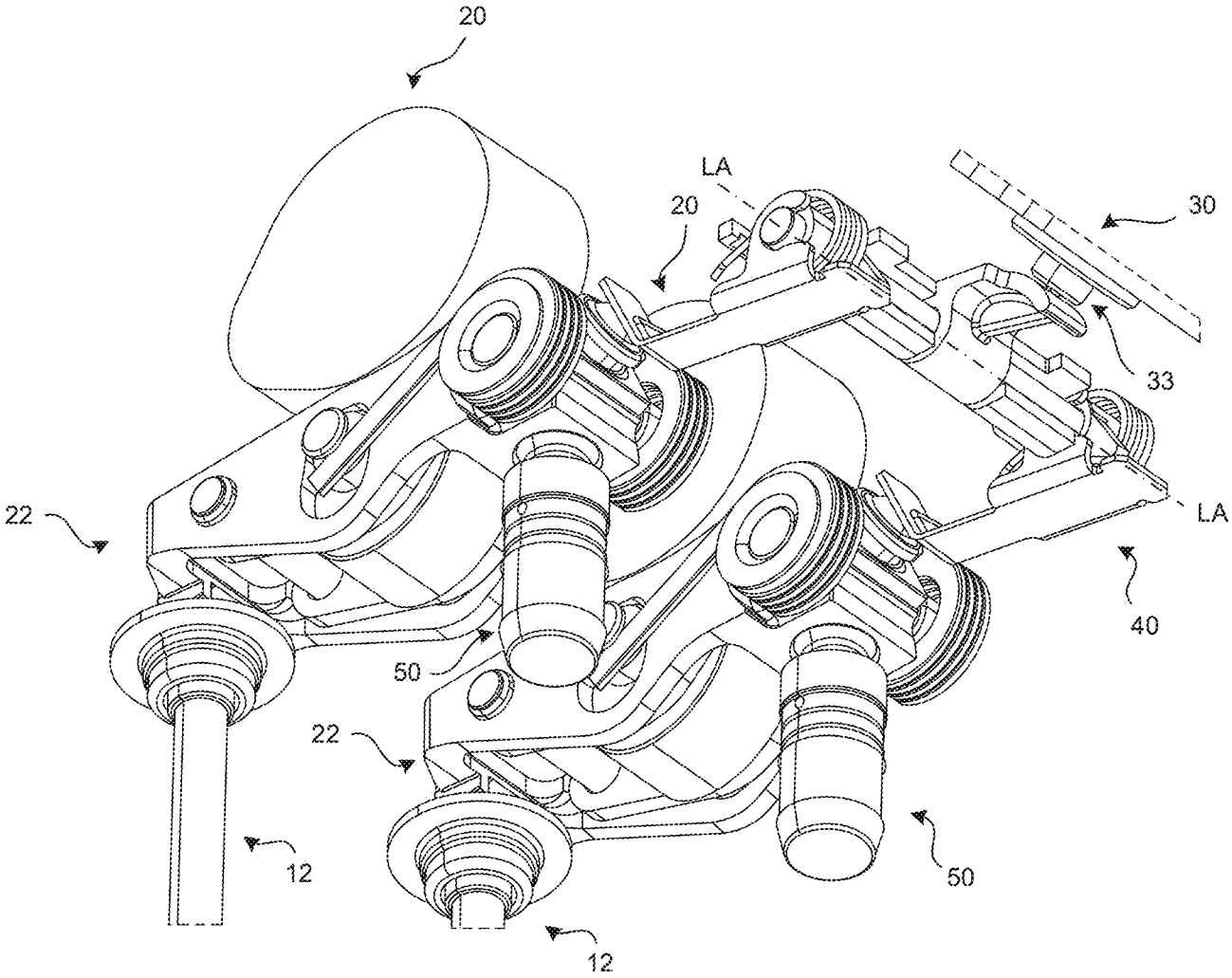
FIG. 2B illustrates a schematic perspective view of a partial valvetrain assembly, showing a rocker arm assembly, an actuator lever assembly, and an actuator pin of an actuator assembly, according to particular embodiments.

FIGS. 2A-2D illustrate particular embodiments of a rocker arm assembly, an actuator switching lever assembly, and an actuator assembly, as non-limiting examples. FIG. 2A illustrates a schematic side cross-sectional partial view of a valvetrain assembly, illustrating a rocker arm assembly, an actuator switching lever assembly, and an actuator assembly, according to particular embodiments. FIG. 2B illustrates a schematic perspective view of a partial valvetrain assembly, showing a rocker arm assembly, an actuator lever assembly, and an actuator pin of an actuator assembly, according to particular embodiments. In particular embodiments, a rotary actuator may be used to provide a switching action to one or more switchable latching pins 270 of rocker arm assembly 22. In particular embodiments, a linear actuator, such as that in actuator assembly 30, may be used to provide a switching action to one or more switchable latching pins 270 of rocker arm assembly 22. According to specific embodiments, an actuator switching lever assembly 40 may be used to enable selective switching of a valvetrain switching mechanism, such as switchable latching pin 270, by a linear actuator, such as a linear actuator mechanism of actuator assembly 30. Linear actuators may have significant advantages in such valvetrain switching applications over rotary or rotation-based actuators. Linear actuators may be less expensive, lighter, easier to package in terms of volume, space claim, and/or form factors, and/or easier to adapt for switching applications. Further, relative to linear actuators, rotary actuators may require relatively complex drivetrains to selectively transmit and control valvetrain switching mechanisms. According to specific embodiments, particular aspects of actuator switching lever assembly 40 may enable reducing a total number of actuators for a given valvetrain assembly 10 of an engine. Such benefits and other advantages of certain inventive aspects of actuator switching lever assembly 40 will be separately or additionally described herein.

Figure 2C:
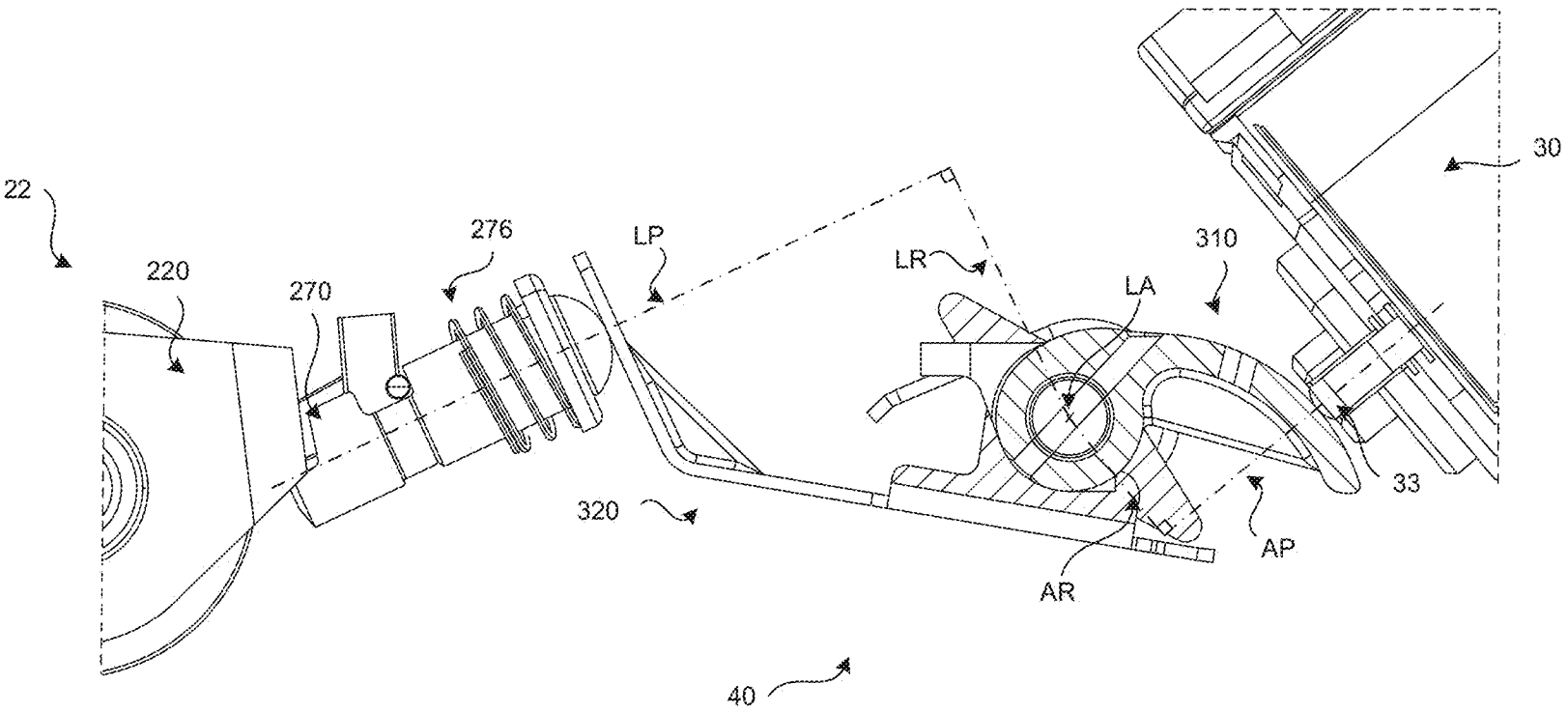
FIG. 2C illustrates a schematic side cross-sectional enlarged partial view of a valvetrain assembly, showing an actuator lever assembly, and an actuator pin of an actuator assembly, according to particular embodiments.
Figure 2D:
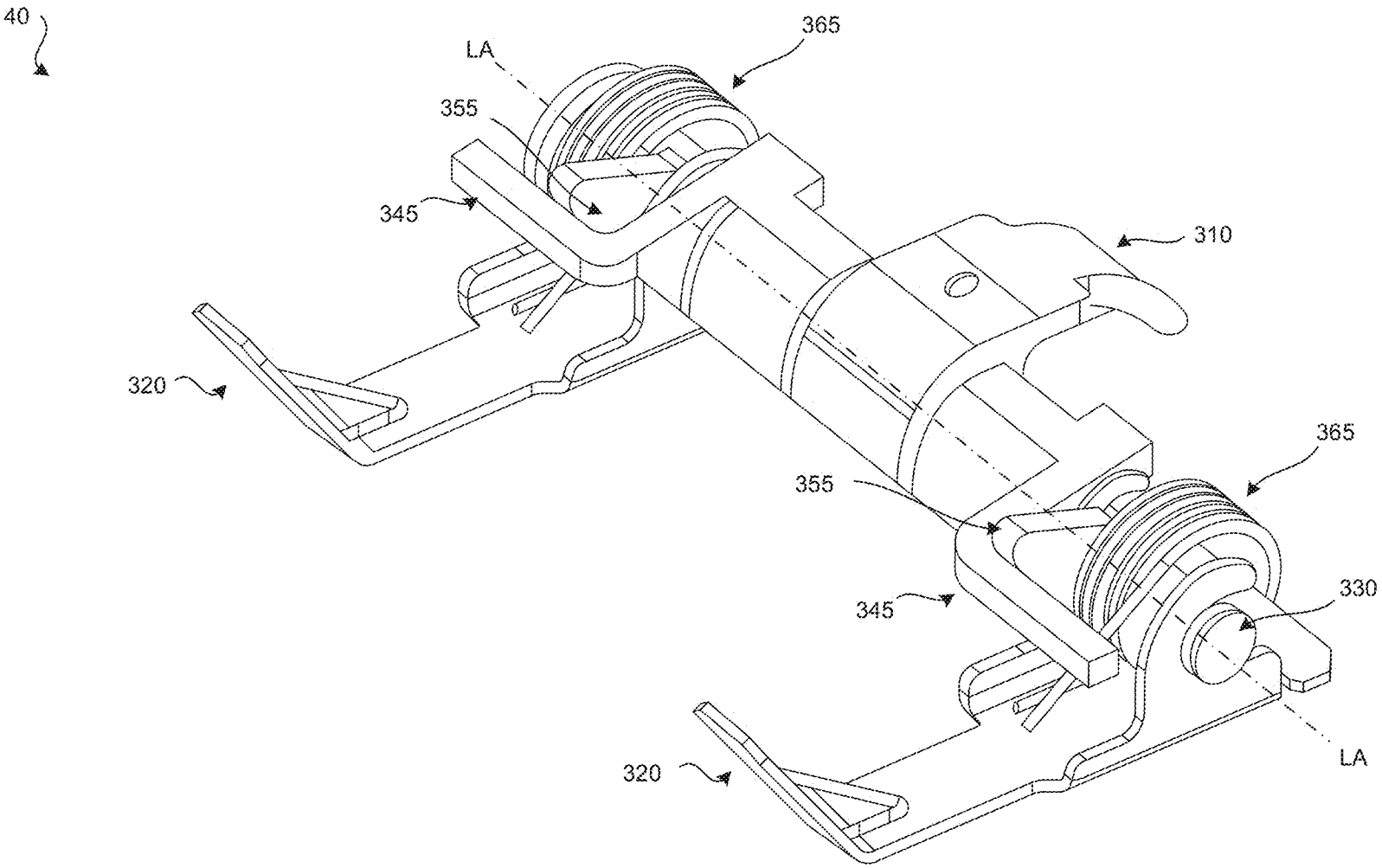
FIG. 2D illustrates a schematic perspective view of an actuator lever assembly, according to particular embodiments.

FIG. 2C illustrates a schematic side cross-sectional enlarged partial view of a valvetrain assembly, showing an actuator lever assembly, and an actuator pin of an actuator assembly, according to particular embodiments. FIG. 2D illustrates a schematic perspective view of an actuator lever assembly, according to particular embodiments.

In particular embodiments, latching pin 270 of rocker arm assembly 22 may be configured to selectively translate along a latching pin longitudinal axis LP, and/or may be configured to be biased toward a locked position or an unlocked position of latching pin 270 by a biasing member, such as latching pin biasing member 276. In particular embodiments, a latching pin 270 of rocker arm assembly 22 may be selectively switchable between positions, such as a locked position and an unlocked position, based on being influenced, engaged with, contacted, provided with a force, and/or otherwise acted upon at a switching element or outer end of latching pin 270, such as by a switching arm 320 of actuator switching lever assembly 40.

In particular embodiments, actuator assembly 30 may comprise an actuator pin 33 configured to selectively and linearly extend and/or retract, such as along an actuator pin longitudinal axis AP, such as driven by a linear solenoid. In particular embodiments, actuator pin 33 may act on a suitable structure of actuator switching lever assembly 40, such as a pin contact surface provided at an end of actuator arm 310. In particular embodiments, a pin contact surface of actuator arm 310 may be configured to cooperatively engage with or contact actuator pin 33 at an orthogonal angle to the axis of linear motion of actuator pin 33, such as actuator pin longitudinal axis AP.

According to specific embodiments, a subset, or a complete set, of interface positions along a contact trajectory of actuator pin 33 along a pin contact surface of actuator arm 310 may be configured to cooperatively engage with or contact actuator pin 33 at an orthogonal angle to the axis of linear motion of actuator pin 33, such as actuator pin longitudinal axis AP, wherein an orthogonal mutual contact as described above may result in forces between actuator pin 33 and pin contact surface of actuator arm 310 that may be entirely axial or longitudinal, and without a radial or sideways component.

In particular embodiments, a subset of interface positions along a contact trajectory of actuator pin 33 along a pin contact surface of actuator arm 310 may be configured to cooperatively engage with or contact actuator pin 33 at a nearly orthogonal mutual angle of contact, wherein "nearly orthogonal" may refer to an angle exceeding 70° to 80° (±10°), such that mutual contact may result in forces between actuator pin 33 and pin contact surface of actuator arm 310 that may be largely axial or longitudinal, i.e., with very small radial or sideways component, if any (numerical values as provided by ranges specified above). In particular embodiments, a pin contact surface of actuator arm 310 may comprise a curved surface. As a non-limiting example, a curved pin contact surface of actuator arm 310 may be curved along a contact trajectory of the said pin contact surface with actuator pin 33.

In particular embodiments, a configuration or inventive design of a pin contact surface of actuator arm 310 to minimize or eliminate any radial or sideways component of force associated with (i.e., for, on, or by) actuator pin 33, as disclosed herein, may enable a more efficient drivetrain, as all, or nearly all, of the linear actuation force exerted by actuator assembly 30 via actuator pin 33 may be usefully applied for switching, as needed. Separately or additionally, frictional forces and/or other losses associated with radial or sideways pin contact may be minimized or eliminated. Further, a minimization and/or elimination of any radial or sideways component of force associated with actuator pin 33 can simplify a design of linear actuator assembly 30, such as design for resisting or support such side loads using bearings or bushings, thereby further reducing cost, packaging size, and weight, and can dramatically decrease wear and tear, maintenance, and/or failures associated with operation and life of the assembly and components therein. As a non-limiting example, actuation and switching of a cylinder deactivation (CDA) rocker arm assembly may occur millions of cycles during engine life, as these events are correlated with engine operating cycle frequencies and timescales. As a non-limiting example, technologies and methodologies such as Dynamic Skip Fire (DSF) may dynamically trigger mode switching of rocker arm states, which may incur or require extremely long useful life of switching-related mechanisms, such as actuation switching lever assembly 40 and actuator assembly 30. By way of illustration and not limitation, reducing, minimizing, and/or eliminating radial or sideways loads on actuator pin 33 may enable an extremely long service life of actuator assembly, such as in excess of tens of millions of switching cycles, or even more.

In particular embodiments, a single actuator switching lever assembly 40 may comprise multiple switching arms 320 (such as two switching arms 320 per actuator switching assembly 40, as illustrated in the non-limiting example of FIG. 2D, or more than two switching arms 320 per actuator switching assembly 40) that may be engaged or operatively coupled to switchably operate and act on corresponding multiple switching elements or latching pins 270 of multiple rocker arm assemblies 22 based on action provided by a fewer number of actuator pins acting on a corresponding number of actuator arms 310 (such as one actuator arm 310 selectively engaged by or with one actuator pin 33 per actuator switching assembly 40, as illustrated in the non-limiting example of FIG. 2D). Accordingly, in particular embodiments, actuator switching assembly 40 may enable operation of switchable rocker arm assemblies 22 with a reduced number of actuator assemblies 30, for example, two switchable rocker arm assemblies 22 operated per one actuator assembly 30, thereby reducing at least complexity, cost, number of moving parts, and weight associated with enabling a switchable valvetrain assembly 10 for an engine, along with improving reliability and providing long operating life.

In particular embodiments, as illustrated in FIG. 2D, actuator switching lever assembly 40 may comprise a lever axle 330 rotatable about a lever axis LA. According to specific embodiments, lever axle 330 may pivotally couple actuator arm 310 and one or more switching arms 320, such that lever axle 330, actuator arm 310, and switching arms 320 may rotate as an integral unit in either rotational direction. In particular embodiments, actuator switching lever assembly 40 may comprise one or more supporting structures, such as lever support 345. In particular embodiments, lever support 345 may be coaxially provided with the lever axle 330, and/or be used to secure or otherwise support actuator switching lever assembly 40 by connecting to a suitable external structure or frame, such as within a cylinder head of an engine. By way of example and not limitation, lever support 345 may be rotationally decoupled from lever axle 330, i.e., free to rotate independent of lever axle 330.

In particular embodiments, one or more over-travel limiters 355 may be provided, which may contact a suitable frame or structure, such as lever support 345, at particular extents of rotation to prevent further rotation of lever axle 330, and its rotationally coupled components. According to specific embodiments, over-travel limiter 355 may be coaxially provided with lever axle 330, and/or coupled to lever axle 330 so as to rotate with it. In particular embodiments, one or more over-travel limiters 355 may be provided to constrain one or more rotational limits of actuator arm 310, and/or one or more switching arms 320.

In particular embodiments wherein one or more over-travel limiters 355 may constrain one or more rotational limits of one or more switching arms 320, a gap may exist under specific conditions between a switching arm 320 and a corresponding latching pin 270 and/or corresponding latching pin biasing member 276. By way of example and not limitation, when an engine valve 12 corresponding to rocker arm assembly 22 is closed, latching pin 270 may be in an engaged position such that a pre-load may be applied to corresponding latching pin biasing member 276, which configuration may be associated with a gap with a corresponding switch arm 320 under particular conditions, as described above. As a non-limiting example, when an engine valve 12 corresponding to a rocker arm assembly 22 is open, such a pre-load may or may not be applied to the latching pin biasing member 276.

In particular embodiments, one or more biasing members, such as lever biasing members 365, may be provided to bias rotation of lever axle 330 and its rotationally coupled components toward one or the other rotational direction about lever axis LA. By way of example and not limitation, a lever biasing member 365 may comprise a spring.

In particular embodiments, a combination of one or more of a suitable load or switching moment arms LR, a suitable actuator moment arm AR, and/or biasing ratings of one or more lever biasing members 365 may be selected or configured based on, or consistent with, one or more of: (a) one or more latching pin parameters, ratings, and/or biasing ratings associated with latching pin 270 and/or latching pin biasing member 276, such as one or more loads, pre-loads, forces, displacements, and/or pin travel distances; (b) one or more force or load ratings and/or parameters associated with actuator pin 33 and/or actuator assembly 30; (c) one or more stroke or displacements ratings and/or parameters relating to an extendable length of actuator pin 33 of actuator assembly 30, and/or otherwise associated with actuator assembly 30.

By way of example and not limitation, a lever biasing member 365 may be configured based on an actuator moment arm AR and switching moment arm LR, which may, in turn, be defined by one or more parameters of the switchable latch pin 270 and/or latching pin biasing member 276. By way of example and not limitation, a load or switching moment arm LR may be considered to be a shortest distance between lever axis LA and a latching pin longitudinal axis LP. By way of example and not limitation, an actuator moment arm AR may be considered to be a shortest distance between lever axis LA and an actuator pin longitudinal axis AP (i.e., an axis of linear motion of the actuator pin 33). As a non-limiting illustrative example, an increase in AR distance would correspond to actuator pin 33 acting further out from lever axis LA; for a fixed or given rotational angle of lever axle 330 (which may correspond to a requirement for switching states by acting on latching pin 270), such an increase-AR configuration may correspond to a larger stroke or maximum displacement length of actuator pin 33. However, such an increased-AR configuration could also require less force to be exerted by actuator pin 33 for the same effective force at latching pin 270, due to the increased leverage of the longer moment arm.

In particular embodiments, actuator pin 33 may be configured to not contact a pin contact surface of actuator arm 310 in a retracted or de-energized state of actuator assembly 30, i.e., maintain a small gap with or between actuator pin 33 and a pin contact surface of actuator arm 310. By way of example and not limitation, for particular embodiments such a configuration may be desirable as certain linear actuators may not immediately produce a full or sufficiently large force at low stroke or displacement values. Accordingly, in particular embodiments, a gap may be provided such that, once actuator assembly 30 is energized, contact may be initially made between extending actuator pin 33 and a pin contact surface of actuator arm 310 at a suitable displacement wherein actuator pin 33 is capable of providing or applying a suitably large force on actuator arm 310.

Figure 3A:
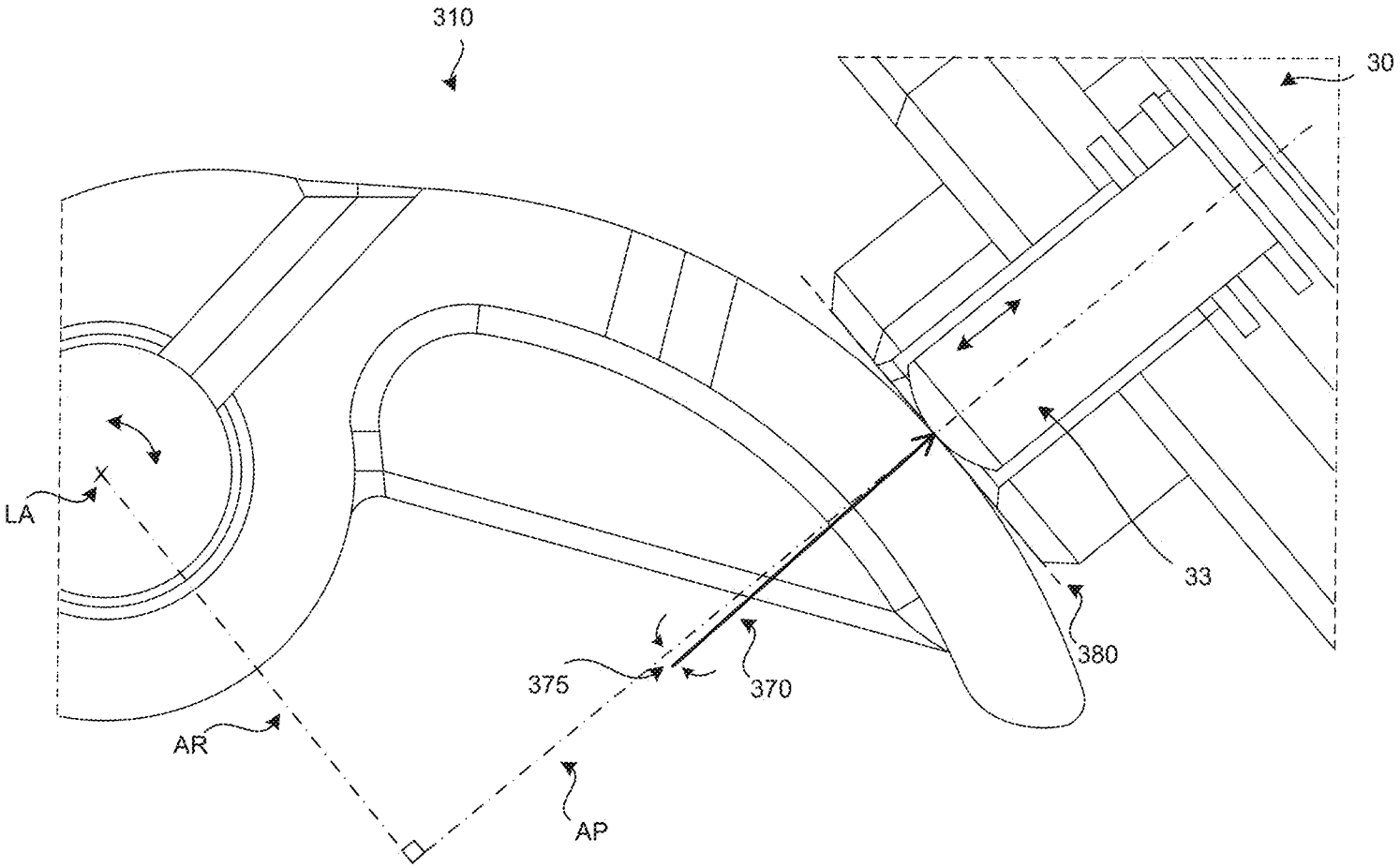
FIG. 3A illustrates a schematic side cross-sectional enlarged partial view of an actuator lever assembly, further illustrating an actuator pin in a retracted position, according to particular embodiments.
Figure 3B:
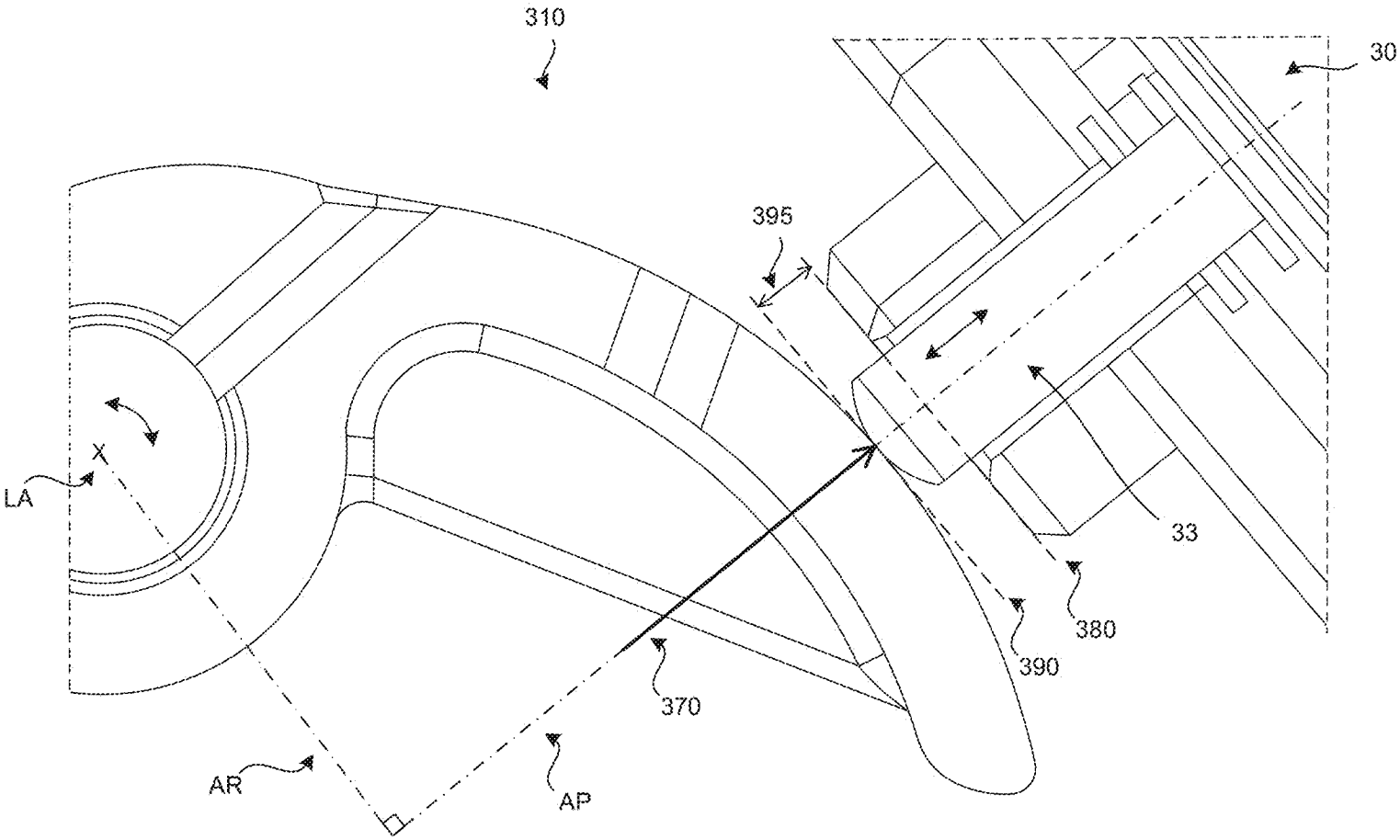
FIG. 3B illustrates a schematic side cross-sectional enlarged view of a partial view of an actuator lever assembly, further illustrating an actuator pin in an extended position, according to particular embodiments.

FIGS. 3A-3B illustrate detailed non-limiting examples of actuator pin operation with a pin contact surface of an actuator lever assembly, according to specific embodiments.

FIG. 3A illustrates a schematic side cross-sectional enlarged partial view of an actuator lever assembly, further illustrating an actuator pin in a retracted or de-energized position, according to particular embodiments. FIG. 3B illustrates a schematic side cross-sectional enlarged view of a partial view of an actuator lever assembly, further illustrating an actuator pin in an extended or energized position, according to particular embodiments.

As a non-limiting example, in FIG. 3A, a curved pin contact surface of actuator arm 310 is illustrated engaging with a fully retracted (but still contacting) actuator pin 33 of a de-energized actuator assembly 30. By way of example, such as for illustrating particular concepts disclosed herein, and not by way of limitation, FIG. 3A illustrates a total force 370 acting on actuator pin 33. Based on the relative geometry of actuator pin 33 with the interface location of pin contact surface of actuator arm 310 at this illustrated retracted pin position 380, total force 370 is shown to act on actuator pin 33 at a small axial offset angle 375 to actuator pin longitudinal axis AP. Stated differently based on vector summation, as illustrated in FIG. 3A, total force 370 would have a large or highly dominant axial or longitudinal force component acting along actuator pin longitudinal axis AP, along with a very small radial or sideways force component acting perpendicular to actuator pin longitudinal axis AP. In other words, further reducing or eliminating the already small (as illustrated) axial offset angle 375 would reduce or eliminate, respectively, the radial or sideways force component acting on actuator pin 33 in this configuration, at this position.

As a further non-limiting example, in FIG. 3B, a curved pin contact surface of actuator arm 310 is illustrated engaging with an extended actuator pin 33 of an energized actuator assembly 30. Relative to the position of FIG. 3A, actuator arm 310 has rotated clockwise (relative to lever axis LA, as seen in the frame of reference of FIGS. 3A-3B), and actuator pin 33 is illustrated in FIG. 3B to be contacting at a different location along the contact trajectory (i.e., relatively closer toward to the lever axis LA along the curve) on the pin contact surface of actuator arm 310. Relative to the displacement of the retracted actuator of FIG. 3A represented by pin position 380, the actuator pin 33 has extended by actuator pin stroke 395 to extended pin position 390.

By way of example, such as for illustrating particular concepts disclosed herein, and not by way of limitation, FIG. 3B illustrates a total force 370 acting on actuator pin 33. Based on the relative geometry of actuator pin 33 with the updated interface location of pin contact surface of actuator arm 310 at this illustrated extended pin position 390, total force 370 is shown to act on actuator pin 33 at a zero axial offset angle 375 (not shown as it is zero) to actuator pin longitudinal axis AP, i.e., the non-limiting example illustrates that at this position, the pin contact surface of actuator arm 310 cooperatively engages with actuator pin 33 at an orthogonal angle to the axis of linear motion of the actuator pin, by design. In practice, according to particular embodiments, a plurality of interface positions along the contact trajectory may be configured such that the pin contact surface of the actuator arm 310 may contact and/or cooperatively engage with the actuator pin 33 at an orthogonal angle to the axis of linear motion of the actuator pin 33, i.e., to actuator pin longitudinal axis AP, thereby enabling the entire load and/or force on the actuator pin to be axial or longitudinal, with no radial or sideways component.

It should be noted that a magnitude or length of the total force vector 370, as illustrated in FIGS. 3A-3B, is arbitrary and should not be taken to be indicative or otherwise used for reference and/or comparison.

In particular embodiments, specific parts of the actuator switching lever assembly 40, such as actuator arm 310, and/or a pin contact surface thereof, may be manufactured by molding, overmolding, casting, investment casting, and/or machining, among others, as some non-limiting examples.

Figure 4A:
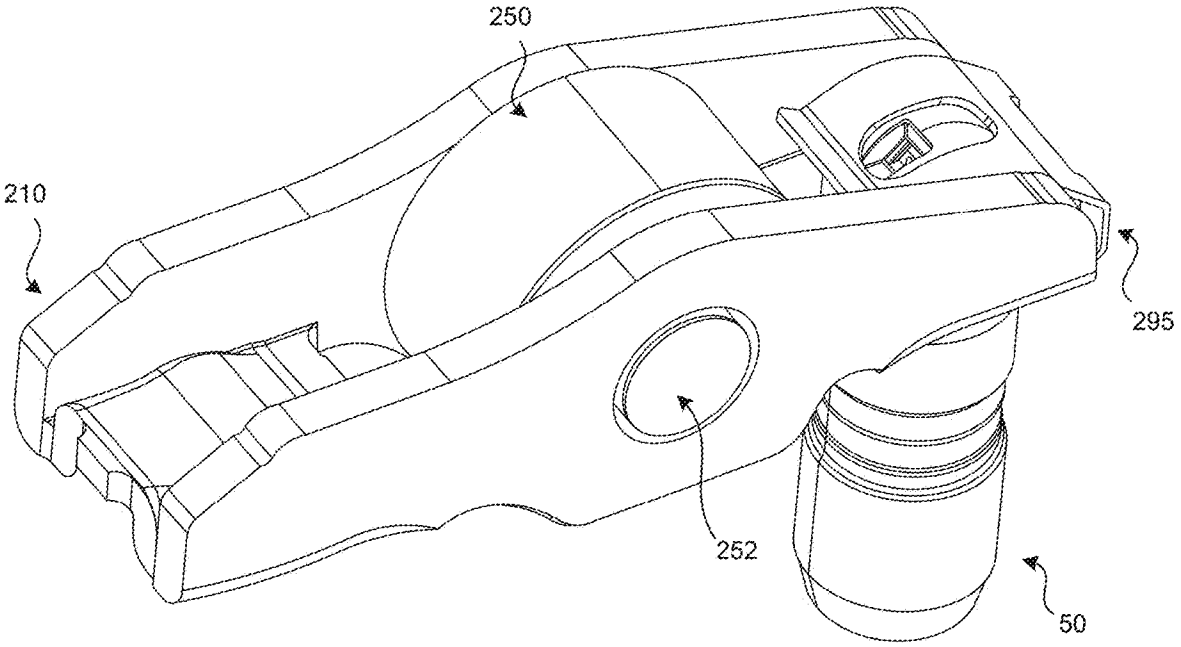
FIG. 4A illustrates a schematic perspective view of a rocker arm assembly, showing an HLA clip, with an HLA installed therein, according to particular embodiments.
Figure 4C:
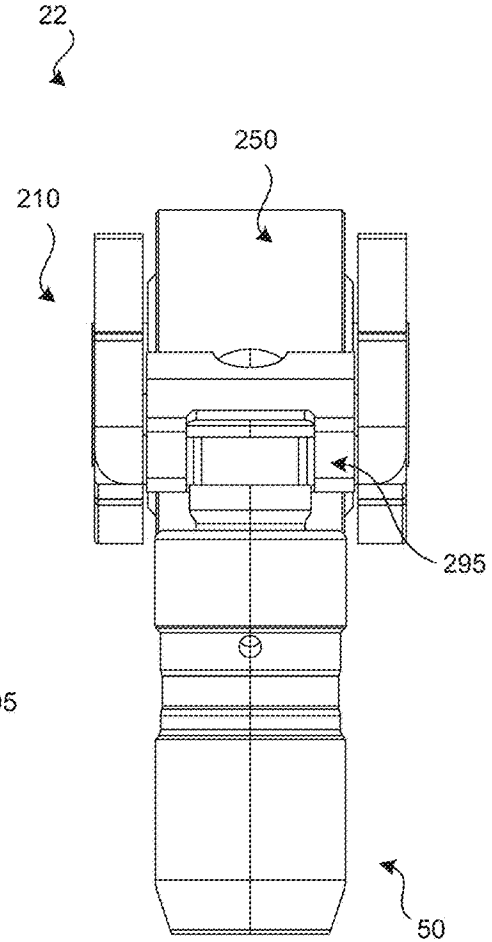
FIG. 4C illustrates a schematic back view of a rocker arm assembly, showing an HLA clip, with an HLA installed therein, according to particular embodiments.
Figure 4B:
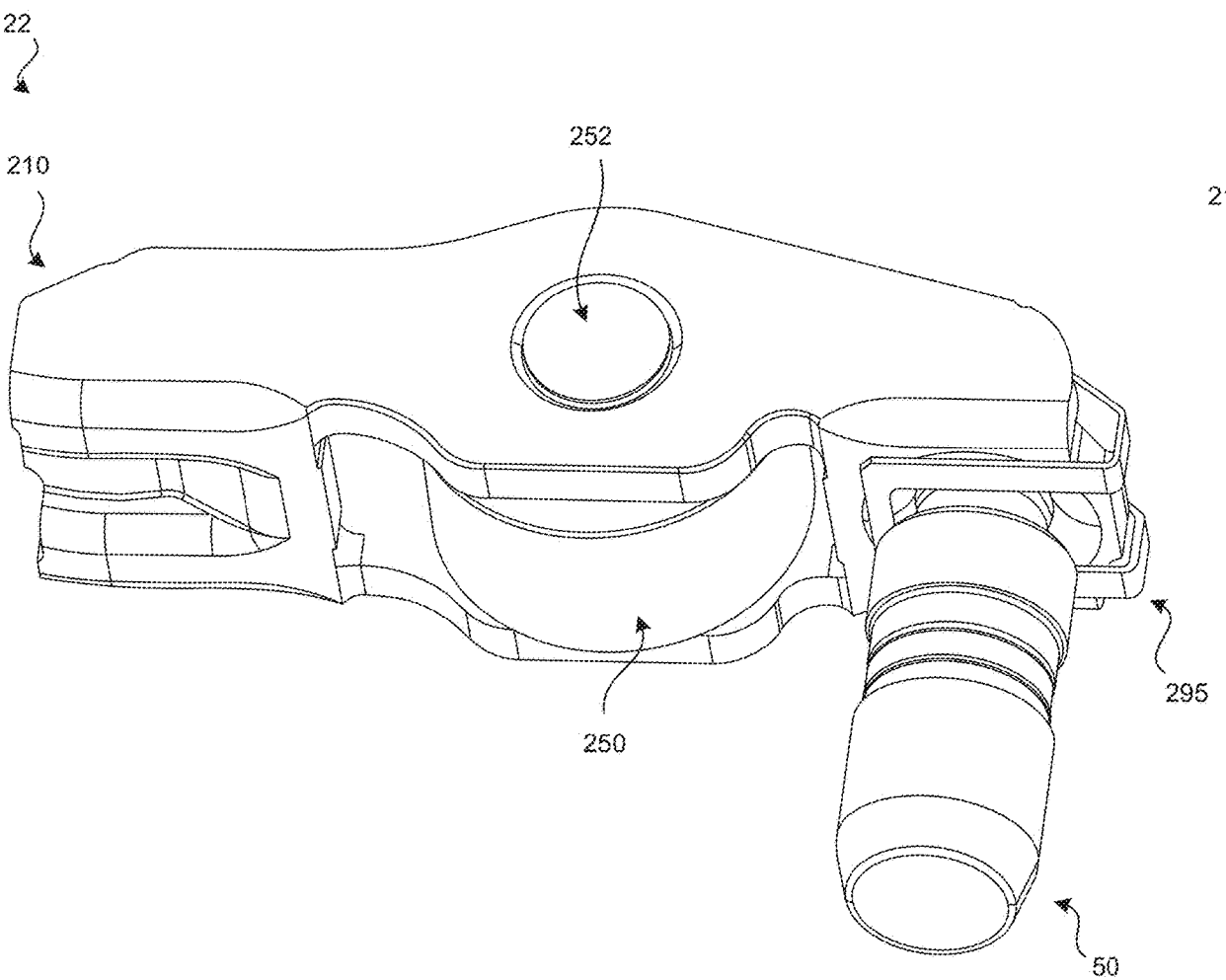
FIG. 4B illustrates a schematic perspective view of a rocker arm assembly, showing an HLA clip, with an HLA installed therein, according to particular embodiments.

FIGS. 4A-4C illustrate particular embodiments of an HLA clip assembled for use with a non-switching rocker arm assembly. FIG. 4A illustrates a schematic perspective view of a rocker arm assembly, showing an HLA clip, with an HLA installed therein, according to particular embodiments. FIG. 4B illustrates a schematic perspective view of a rocker arm assembly, showing an HLA clip, with an HLA installed therein, according to particular embodiments. FIG. 4C illustrates a schematic back view of a rocker arm assembly, showing an HLA clip, with an HLA installed therein, according to particular embodiments.

In particular embodiments, a rocker arm assembly 22 may be provided with a hydraulic lash adjustment (HLA) assembly, such as HLA assembly 50. By way of example and not limitation, an HLA assembly 50 may provide automatic compensation for lash between interfacing surfaces and/or components. As a non-limiting example, HLA assembly 50 may be configured to selectively expand and/or extend to close and/or eliminate mechanical lash. Separately or additionally, HLA assembly 50 may be configured to collapse or close as needed, to ensure intended operation, such as enabling one or more engine valves that may be intended to fully close to do so as and when intended. As a non-limiting example, such a lash adjustment or compensation may be desirable under particular conditions to enable safe, efficient, and/or reliable engine operation, and/or to ensure appropriate valve timing, valve opening and/or valve closing operation. Such a lash adjustment or compensation may be necessitated in particular embodiments based on potential relative and absolute thermal expansions, tolerances, wear and tear, and/or other effects and variabilities. In particular embodiments, rocker arm assembly 22 may be provided with an HLA interface 290. By way of example and not limitation, HLA interface 290 may comprise a cavity of a suitable shape to receive HLA assembly 50. As a non-limiting example, HLA interface 290 may comprise a cavity having an ogive shape.

While this disclosure particularly contemplates hydraulic lash adjusters (HLA), and other features related thereof, it should be appreciated this disclosure contemplates other kinds of lash adjusters, such as mechanical lash adjusters, non-hydraulic lash adjusters, and/or mechanisms, in each applicable respect thereof.

In particular embodiments, a coupler, connector, clip, and/or other securement, such as HLA clip 295, may be provided to connect, secure, constrain, and/or otherwise support HLA assembly 50 relative to rocker arm assembly 22. In particular embodiments, HLA clip 295 may be provided for constraining HLA assembly 50 with rocker arm assembly 50 in position when regular operating forces may not (yet) be acting on the assembly or partial assembly. By way of example and not limitation, HLA clip 295 may be provided during manufacturing and/or assembly to connect and secure HLA assembly 50 with one or more suitable parts of rocker arm assembly 22, such as outer body 210. As a non-limiting example, HLA clip 295 may prevent inadvertent disassembly or decoupling of rocker arm assembly 22 and/or HLA assembly 50 during production, such as due to vibrations or undesired movement of a partial assembly. For instance, in the absence of HLA clip 295, rocker arm assembly 22 may be unsupported or unstable for assembly or production until a camshaft is appropriately located and relatively constrained, as a non-limiting example. As another non-limiting example, HLA clip 295 may be used to constrain and/or otherwise support disassembly of components during maintenance and servicing. In particular embodiments, HLA clip 295 may be required to remain positionally unchanging and constrained through the operational life of the overall assembly, despite factors such as static and dynamic loads, wear and tear, and widely changing operating and ambient conditions.

Figure 5A:
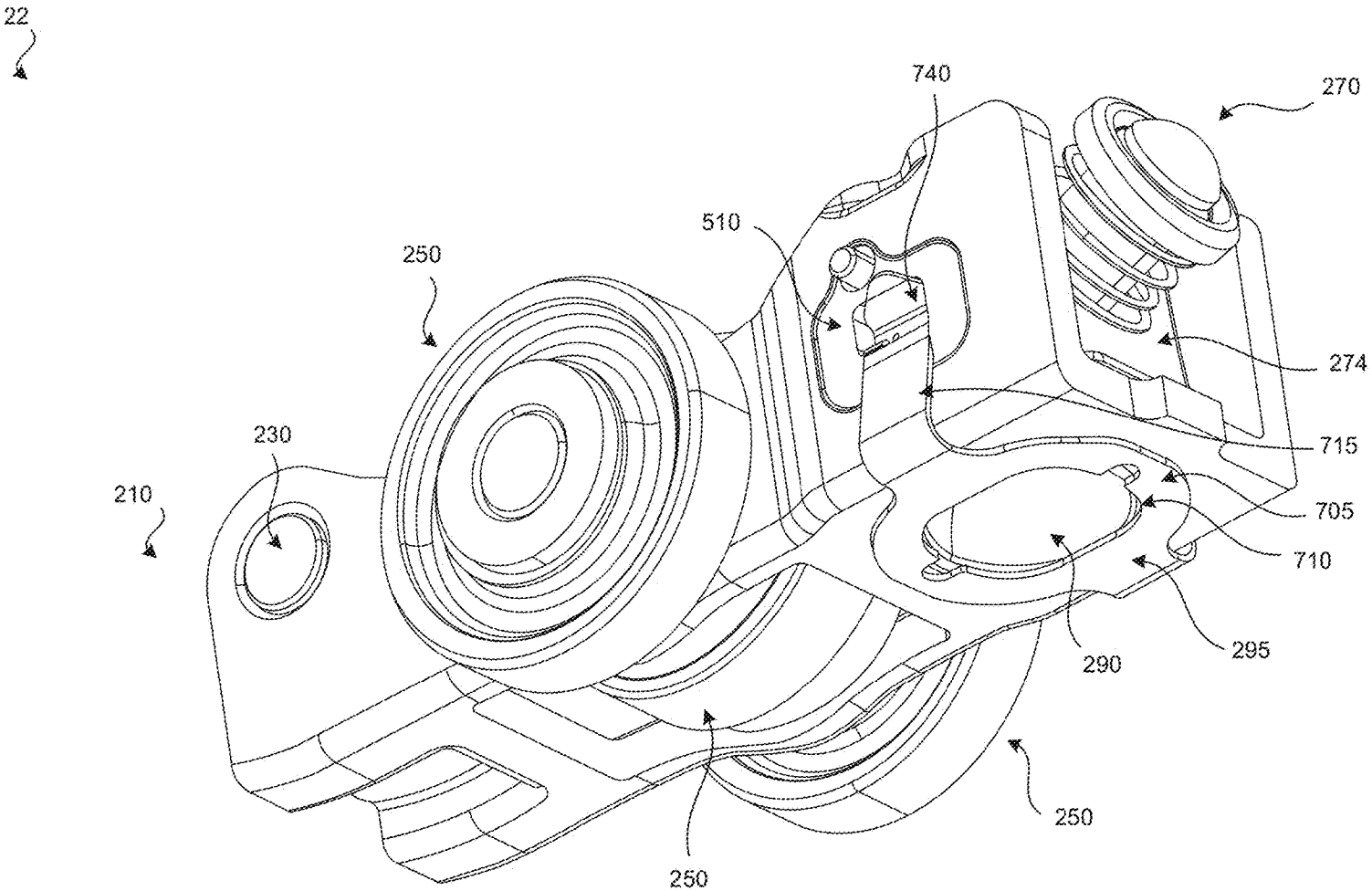
FIG. 5A illustrates a schematic perspective view of a rocker arm assembly, showing an HLA clip installed, according to particular embodiments.
Figure 5C:
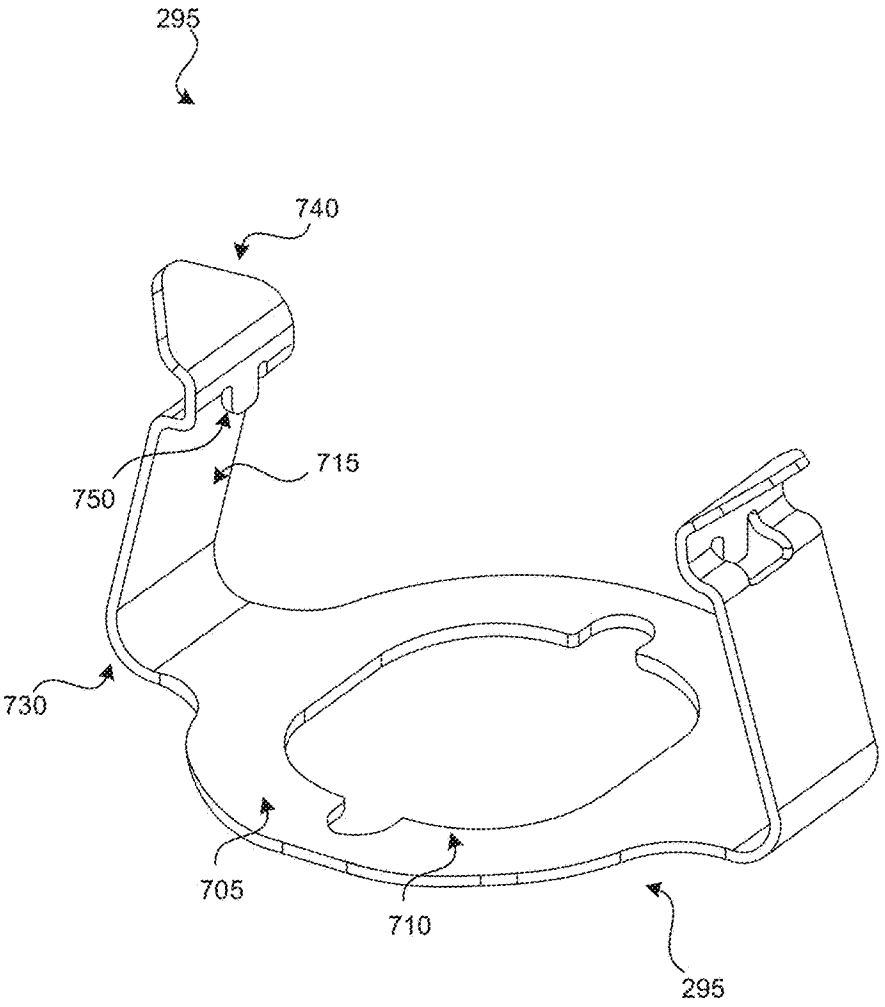
FIG. 5C illustrates a schematic perspective view of an HLA clip, according to particular embodiments.
Figure 5B:
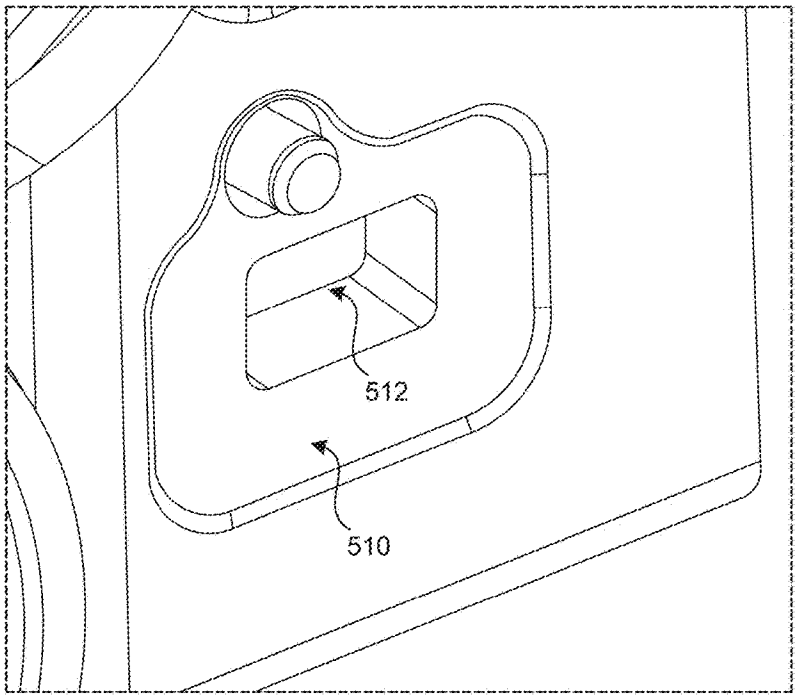
FIG. 5B illustrates a schematic perspective enlarged partial view of a rocker arm assembly, showing details of an outer body window, according to particular embodiments.

FIGS. 5A-5C illustrate particular embodiments of an HLA clip for use with a switching rocker arm assembly. FIG. 5A illustrates a schematic perspective view of a rocker arm assembly, showing an HLA clip installed, according to particular embodiments. FIG. 5B illustrates a schematic perspective enlarged partial view of a rocker arm assembly, showing details of an outer body window, according to particular embodiments. FIG. 5C illustrates a schematic perspective view of an HLA clip, according to particular embodiments.

In particular embodiments, rocker arm assembly 22 may be configured to support multiple rollers 250, and/or absorb partial rather than large cam lift profiles. As a non-limiting example, rocker arm assembly 22 of FIGS. 5A-5C may be suitable for applications such as variable valve lift (VVL). As has been previously noted and illustrated by way of example and not limitation, such as by rocker arm biasing member 280 in FIG. 1D, particular components in such applications may be relatively modestly sized, such that it may be possible to design and/or package HLA clip 295 as illustrated in FIG. 5A. As illustrated in FIGS. 5A and 5B, an aperture or feature such as rocker arm window 510 may be provided on a suitable part of rocker arm assembly 22, such as outer body 210, to receive corresponding features of an HLA clip 295.

In particular embodiments, an HLA clip base 705 of HLA clip 295 may comprise one or more features, such as HLA clip base aperture 710, to accommodate and/or enable HLA interface 290 to be accessible by HLA assembly 50, and operate as intended.

In particular embodiments, HLA clip 295 may comprise one or more HLA clip arms 715 extending from HLA clip base 705, each HLA clip arm 715 having one end coupled to the HLA clip base 705. In particular embodiments, the respective coupled ends of HLA clip arms 715 may be evenly or unevenly distributed around the perimeter of the HLA clip base 705.

In particular embodiments, prior to assembly of HLA clip 295 with rocker arm assembly 22, HLA clip arms 715 may be coupled with HLA clip base 205 at an angle, and/or otherwise provided such that the HLA clip arms 715 may lean in toward each other, and/or toward the HLA clip base 705. According to particular embodiments, the farther or outer ends of HLA clip arms 715 may be angled toward a longitudinal axis of HLA clip 295, i.e., an axis that is orthogonal to HLA clip base 705 and passing through HLA clip base 705. In particular embodiments, HLA clip arms 715 may be coupled with HLA clip base 205 such that, following assembly of HLA clip 295 with rocker arm assembly 22, HLA clip arms 715 may exert an inward clamping force on rocker arm assembly 22 (such as on outer arm 210).

In particular embodiments, HLA clip arms 715 may exert a clamping force on one or more structural aspects of rocker arm assembly 22 when assembled with rocker arm assembly 22. By way of example and not limitation, a clamping force may be exerted along substantial surface-to-surface contact portions between HLA clip arms 715 and rocker arm assembly, and not just at local pinch points, tabs, and/or indents.

In particular embodiments, HLA clip arms 715 may be coupled with HLA clip base 205 at a coupling feature such as a curved corner 730, the curvature of the curved corner facilitating reduced stress concentration at the coupling feature.

In particular embodiments, the curved corner 730 may extend past the base in an opposite direction to a direction of the HLA clip arms 715 extending from the base. By way of example and not limitation, curved corners 730 may form the farthest extent of HLA clip 295 in one direction along the axis perpendicular to the HLA clip base 705, and passing through the HLA clip base 705. In particular embodiments, a curved corner 730 coupling an HLA clip arm 715 mat extends past the particular HLA clip arm 715 in an opposite direction to the axis orthogonal to and passing through the HLA clip base 705.

In particular embodiments, one or more ends of HLA clip arms 715 located opposite the ends that may be coupled with HLA clip base 705 may be provided with locking tabs 740. By way of example and not limitation, a locking tab 740 may comprise a loop, curvature, indentation or other inward-oriented feature of or on HLA clip arms 715, wherein "inward" refers to a direction for each HLA clip arm 715 toward a correspondingly assembled rocker arm assembly 22 (whether assembled yet or not).

In particular embodiments, in an assembled state of HLA clip 295 with rocker arm assembly 22, a closest distance between locking tabs 740 of HLA clip arms 715 located opposite each other may be less than a corresponding widest separation distance of rocker arm assembly 22. By way of example and not limitation, locking tabs 740 may be configured to fit and/or snap into a locally narrow feature of rocker arm assembly 22, such as rocker arm window 510, in particular embodiments. By way of example and not limitation, locking tabs 740 may be configured to extend past a body length of rocker arm assembly 22, and fit and/or snap around the body length dimension of interest, in particular embodiments (such as illustrated in the non-limiting example of FIG. 6B or 8A or 8B).

In particular embodiments, each locking tab 740 may be provided to engage with a suitable edge, surface, or other feature of rocker arm assembly 22, such that HLA clip 295 may not be easily and/or inadvertently separated or disassembled from rocker arm assembly 22.

In particular embodiments, some or all locking tabs 740 may each be provided with one or more projections, such as locking indents 750, to further assure or enable engagement of HLA clip 295 with a suitable edge, surface, or other feature of rocker arm assembly 22, such that HLA clip 295 may not be easily and/or inadvertently separated or disassembled from rocker arm assembly 22. In particular embodiments, locking indents 750 may be configured to engage with a specific corresponding feature of rocker arm assembly 22, such as an inner edge 512 of rocker arm window 510 (non-limiting example of FIG. 5B), or a coined edge 810 of outer body 210 (non-limiting example of FIG. 8B). In particular embodiments, identical (to above described non-limiting examples) or particularly modified locking indents 750 may engage with more general and/or non-specific aspects of rocker arm assembly 22, such as flat edge 820 of outer body 210 (non-limiting example of FIG. 8D), while still providing useful and adequate mutual engagement to assure secure coupling of HLA clip 295 with rocker arm assembly 22 throughout a time period of expected or required service. In particular embodiments, a locking indent 750 may comprise an extension or pin-like or tab-like feature, one or more locking indents 750 extending from particular locking tabs 740. In particular embodiments, a locking indent 750 may comprise a projection pointed toward the HLA clip base 705. By way of example and not limitation, a locking indent 750 may be configured to contact an engaging surface with a reduced contact surface area and/or reduced potential for relative sliding motion.

In particular embodiments, HLA clip 295 may be assembled with rocker arm assembly 22 by temporarily spreading or diverging HLA clip arms 715 to a sufficient and controlled extent to enable HLA clip 295 to be snapped on to rocker arm assembly 22, followed by assuring that additional or locking features of HLA clip 295, such as locking tabs 740 and/or locking indents 750 are appropriately placed and locked on corresponding aspects or features of rocker arm assembly 22. By way of example and not limitation, some corresponding features of rocker arm assembly 22 may include one or more rocker arm windows 510; coined, or otherwise modified edges or surfaces, such as coined edge 810, and/or otherwise suitable existing features of rocker arm assembly 22 such as flat edge 820 that provide secure and adequate locking performance with the securing features of HLA clip 295.

In particular embodiments, HLA clip 295 may be made from materials that may provide ability to sustain momentary deformation while preserving an ability to spring back when released, i.e., exhibiting suitable elastic deformation qualities, and/or resisting plastic deformation. In particular embodiments, HLA clip 295 may be made from resilient materials, which may return to their original shape after being bent, stretched, or otherwise deformed. By way of example and not limitation, suitable materials for HLA clip 295 may enable it to apply an tension or clamping force on rocker arm assembly 22 in assembled configuration, based on at least HLA clip arms 715 that lean inward when not assembled, said HLA clip arms provided with tension force by appropriately and momentarily spreading HLA clip arms 715 outward to assembly HLA clip 295 with rocker arm assembly 22. In particular embodiments, HLA clip 295 may be made from "music wire" steel, spring steel, C67 steel, or other materials, which may optionally be treated to impart some or all of the characteristics described herein.

Figure 6A:
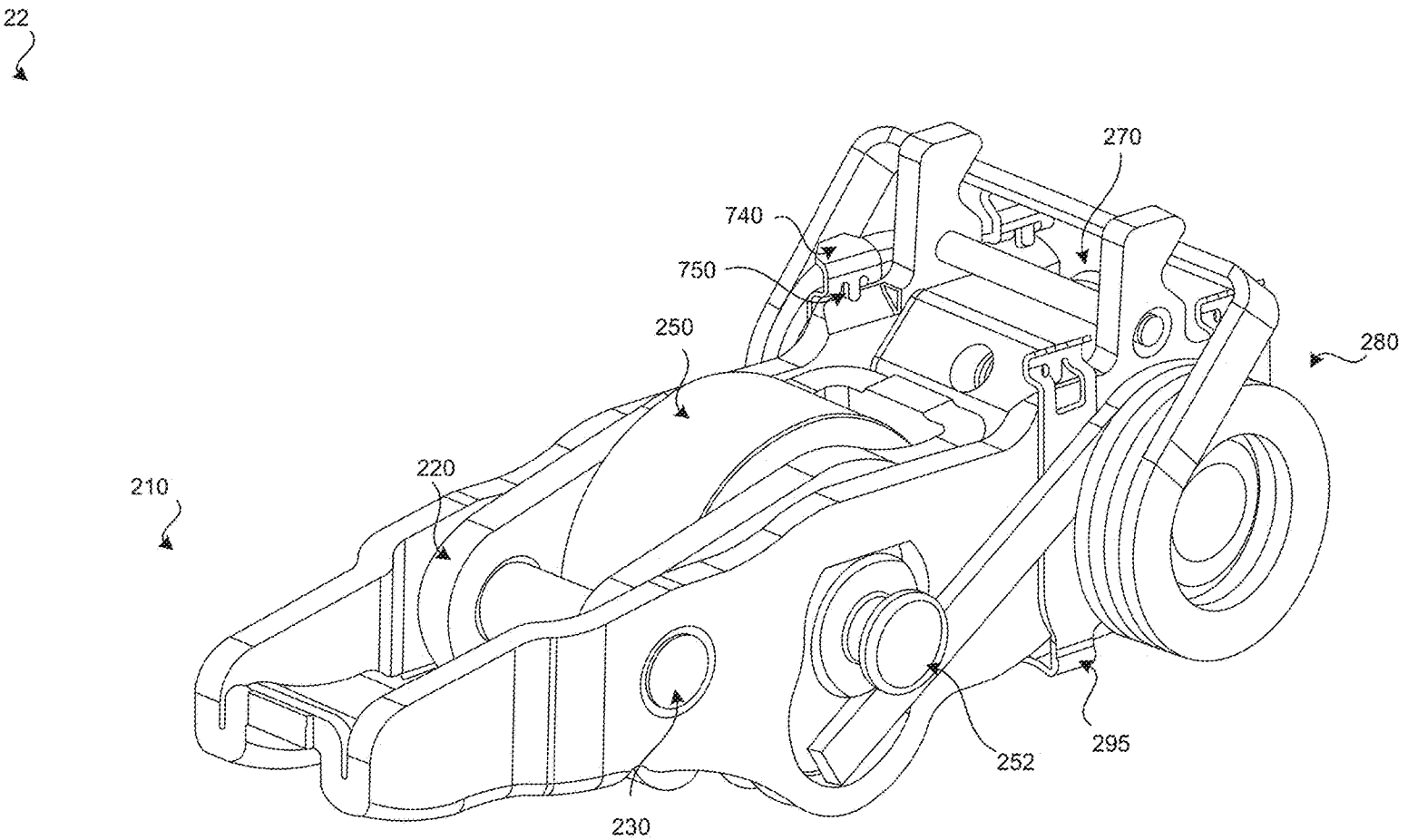
FIG. 6A illustrates a schematic perspective view of a rocker arm assembly, showing an HLA clip installed, according to particular embodiments.
Figure 6B:
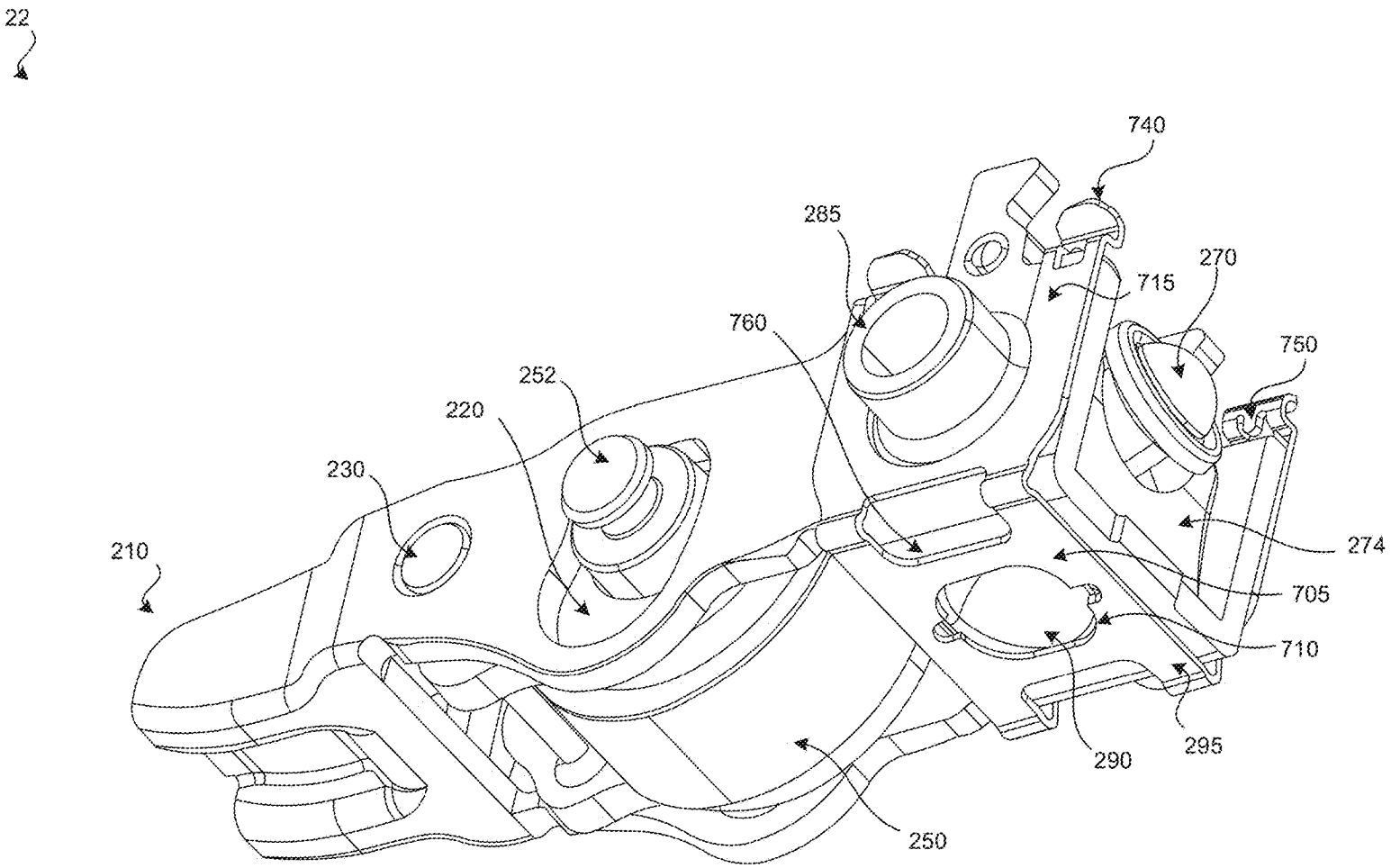
FIG. 6B illustrates a schematic perspective view of a rocker arm assembly, showing an HLA clip installed, according to particular embodiments.

FIGS. 6A-6B illustrate schematic perspective views of a rocker arm assembly, showing an HLA clip installed, according to particular embodiments. FIGS. 7A-7D schematic perspective views of an HLA, according to particular embodiments.

In particular embodiments, rocker arm assembly 22 may be configured to support a single roller 250, and/or absorb large cam lift profiles or displacements. As a non-limiting example, rocker arm assembly 22 of FIGS. 6A-6B may be suitable for applications such as cylinder deactivation (CDA). As has been previously noted and illustrated by way of non-limitation examples, such as by rocker arm biasing member 280 in FIG. 1B or 6A, particular components in such applications may be relatively large and bulky, such that it may be additionally challenging to design and/or package HLA clip 295, as illustrated in FIG. 6A-6B.

Figure 7B:
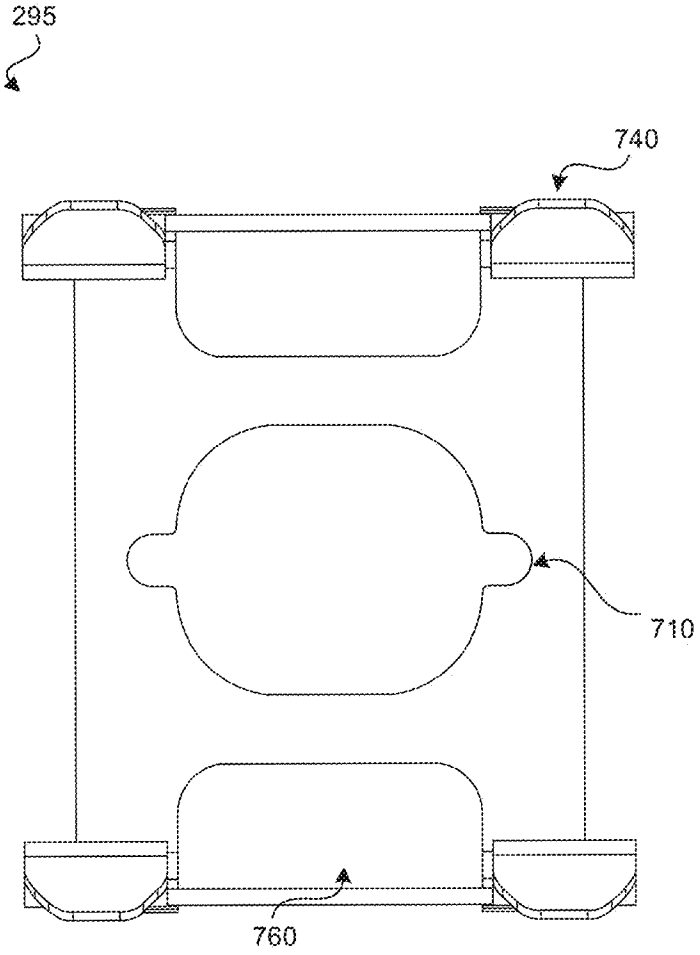
FIG. 7B illustrates a schematic top view of an HLA clip, according to particular embodiments.
Figure 7A:
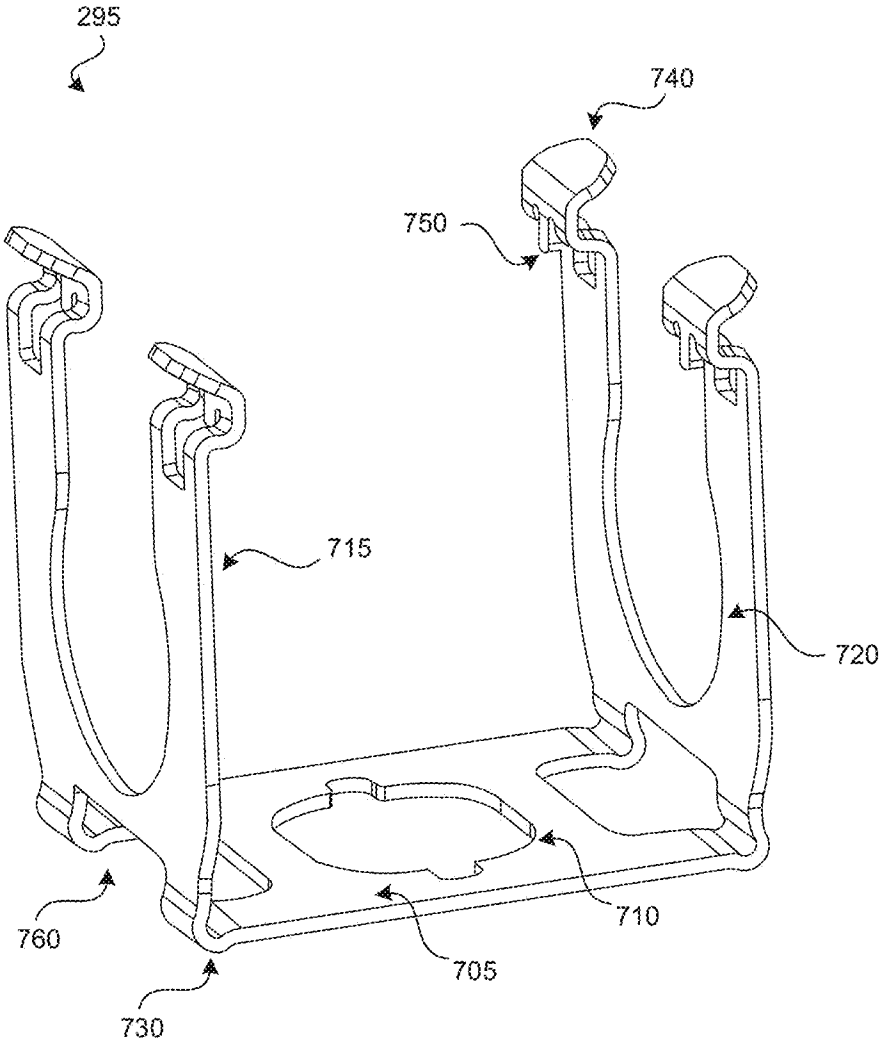
FIG. 7A illustrates a schematic perspective view of an HLA clip, according to particular embodiments.
Figure 7D:
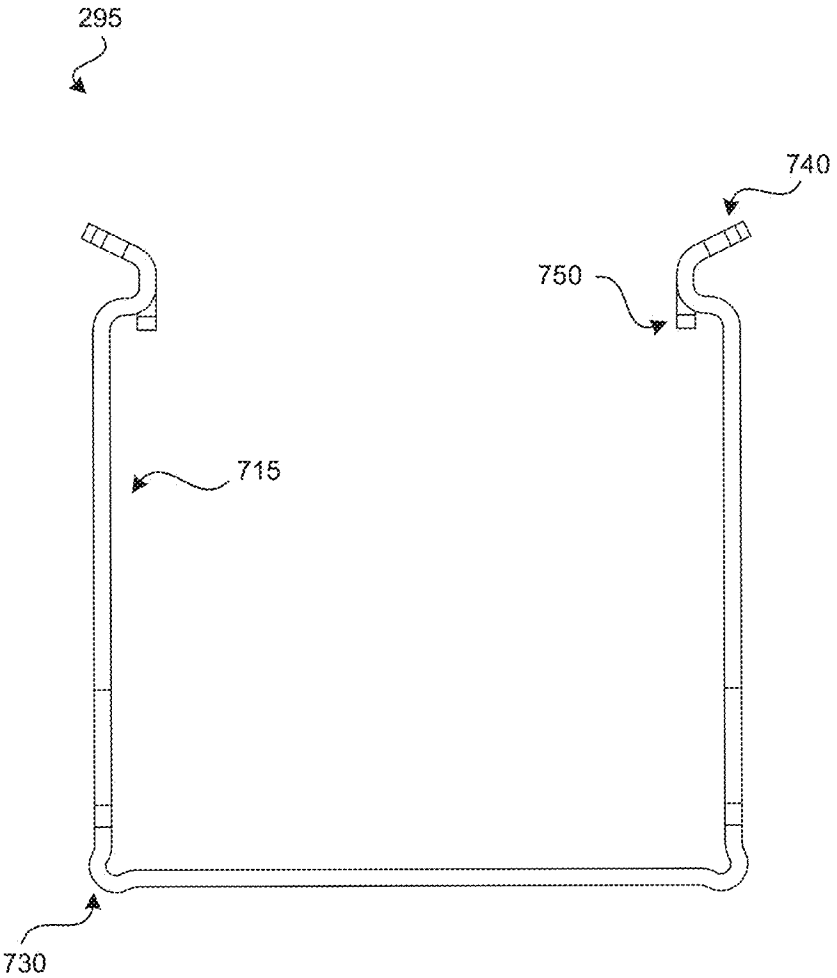
FIG. 7D illustrates a schematic front view of an HLA clip, according to particular embodiments.
Figure 7C:
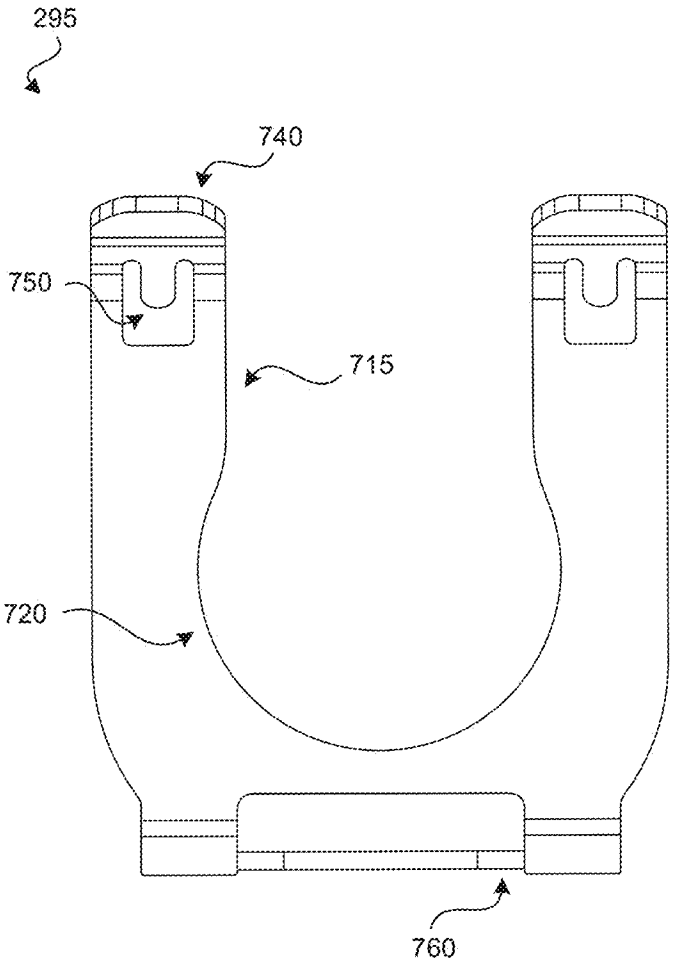
FIG. 7C illustrates a schematic side view of an HLA clip, according to particular embodiments.

FIG. 7A illustrates a schematic perspective view of an HLA clip, according to particular embodiments. FIG. 7B illustrates a schematic top view of an HLA clip, according to particular embodiments. FIG. 7C illustrates a schematic side view of an HLA clip, according to particular embodiments. FIG. 7D illustrates a schematic front view of an HLA clip, according to particular embodiments.

By way of example and not limitation, separate or additional to aspects and features already discussed with respect to FIGS. 5A-5C, large and/or bulky features such as rocker arm biasing member 280 (illustrated in the non-limiting examples of FIG. 1B or 6A) may require large and/or extended support structures, such as rocker arm boss 285, to be provided on rocker arm assembly 22. In particular embodiments, separate or additional features such as rocker arm boss aperture 720 and/or base cutout 760 may be provided on HLA clip 295, to accommodate and/or take advantage of specific features of rocker arm assembly 22. It should be appreciate that while particular features, such as rocker arm boss aperture 720, may be particularly suited to specific embodiments of rocker arm assemblies 22 (such as illustrated in FIG. 6B), the use or combination of such features or aspects may not be limited to embodiments of HLA clip 295 used with those specific rocker arm assembly 22 embodiments. In particular embodiments, for example, pairs (or other numerical combinations) of HLA clip arms 715 may be arranged so that appropriate spacings may enable the pair (or other numerical combinations) to surround, gird, encircle, wrap around, or fork around one or more structures of the rocker arm assembly, such as projecting or protruding structures. In particular embodiments, pairs (or other numerical combinations) of HLA clip arms 715 may be arranged so that they merge or couple with each other at one or more locations away from the base, such as halfway up their lengths, or closer to the tabs, or past the tabs near their respective ends.

Figures 8A, 8B:
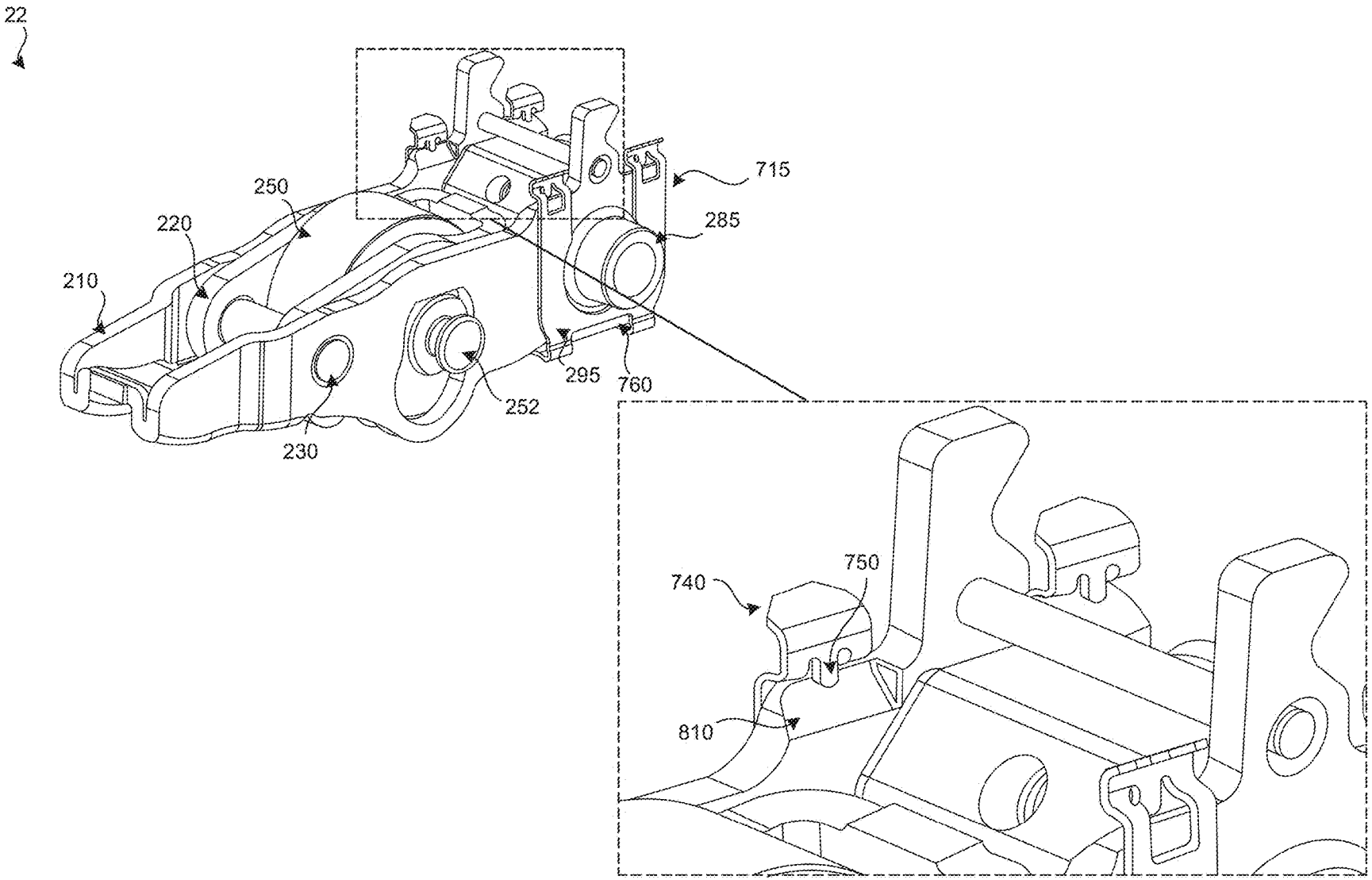
FIG. 8A illustrates a schematic perspective view of a rocker arm assembly, showing an HLA clip installed, the outer body illustrated with a coined edge, according to particular embodiments.
FIG. 8B illustrates a schematic perspective enlarged partial view showing particular details of FIG. 8A, according to particular embodiments.
Figures 8C, 8D:
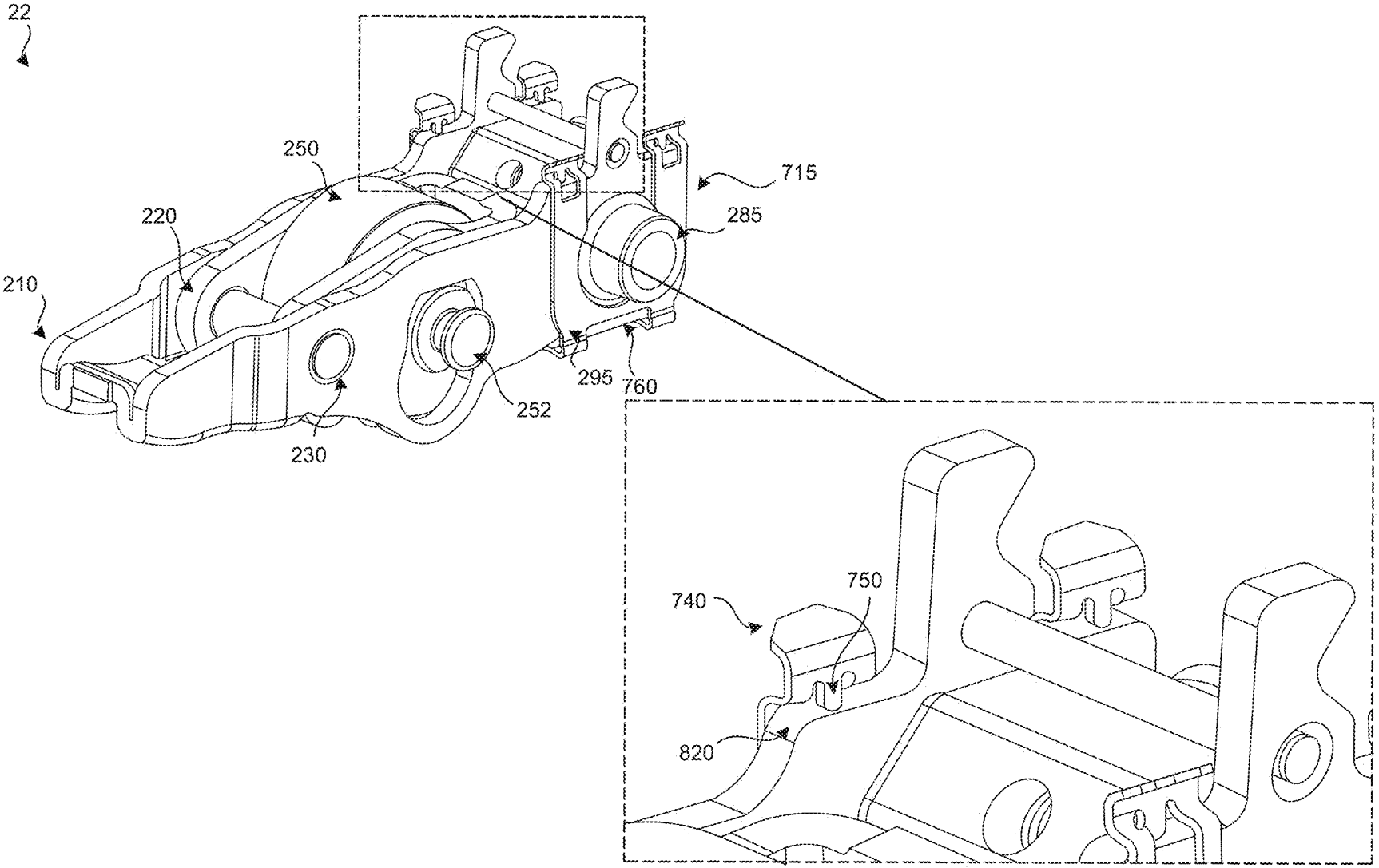
FIG. 8C illustrates a schematic perspective view of a rocker arm assembly, showing an HLA clip installed, the outer body illustrated with a non-coined edge, according to particular embodiments.
FIG. 8D illustrates a schematic perspective enlarged partial view showing particular details of FIG. 8C, according to particular embodiments.

FIGS. 8A-8B illustrate a schematic perspective view (along with a partial enlargement of particular details) of a rocker arm assembly, showing an HLA clip installed, the outer body illustrated with a coined edge, according to particular embodiments. FIGS. 8C-8D illustrate a schematic perspective view (along with a partial enlargement of particular details) of a rocker arm assembly, showing an HLA clip installed, the outer body illustrated with a non-coined edge, according to particular embodiments. In particular embodiments, features such as coining or edge or surface modification may be created based on metal sheet working, tooling, machining, casting, investment casting, and/or other suitable processes.

As has been previously discussed herein, while particular features such as locking tabs 740 and/or locking indents 750 may be, or may appear to be, particularly suited to specific features provided, such as a rocker arm assembly 22 having a coined or specifically formed edge 810 on outer body 210 in FIG. 8B, the same features may be fully useful, and/or may be fully contemplated, in other embodiments, such as a rocker arm assembly 22 having a flat or regular-thickness or unmodified edge 820 on outer body 210 in FIG. 8D. While the above illustrations serve as non-limiting examples, the non-limiting combinability fully extends to aspects formed by combining other features and/or embodiments. Various embodiments of HLA clip 295 may be created with various features, and/or may be used with various types of rocker arms assemblies 22.

FIGS. 9A-9D illustrate particular aspects of a rocker arm assembly, particular illustrating a latching pin body assembly therein, and/or coupling thereof, according to particular embodiments.

Figure 9A:
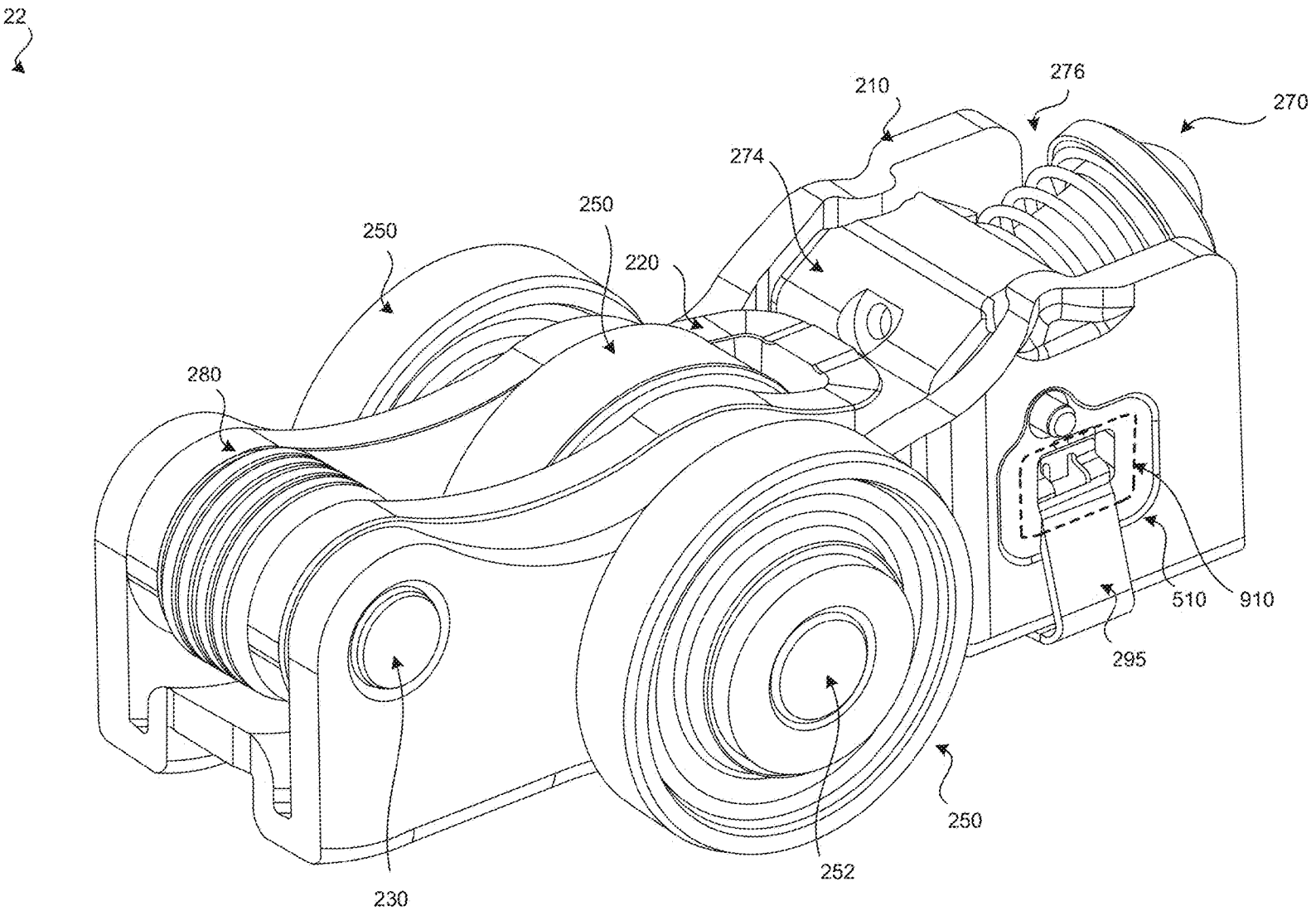
FIG. 9A illustrates a schematic perspective view of a rocker arm assembly, further illustrating a latching pin body assembly therein, according to particular embodiments.

FIG. 9A illustrates a schematic perspective view of a rocker arm assembly, further illustrating a latching pin body assembly therein, according to particular embodiments. In particular embodiments, latching pin body 274 may be initially provided separately from rocker arm assembly 22, and may be assembled or coupled with outer body 210 during production of rocker arm assembly 22. In particular embodiments, latching pin body 274 may be coupled with outer body 210 by welding operation, such as by laser welding. By way of example and not limitation, welding path or location 910 may be provided within rocker arm window 510 of rocker arm assembly 22 to couple latching pin body 274 with outer body 210. In particular embodiments, weld path or location 910 may be traversed for overlap welding. By way of example and not limitation, an overlap welding based on weld path or location 910 may welding through a first layer of material, such as a thickness of outer box 210, the welding beam or energy further penetrating past the first layer into a second layer of material, such as a thickness of latching pin body 274, sufficient to couple them for the requirements of the rocker arm assembly 22 and its applications.

Figure 9B:
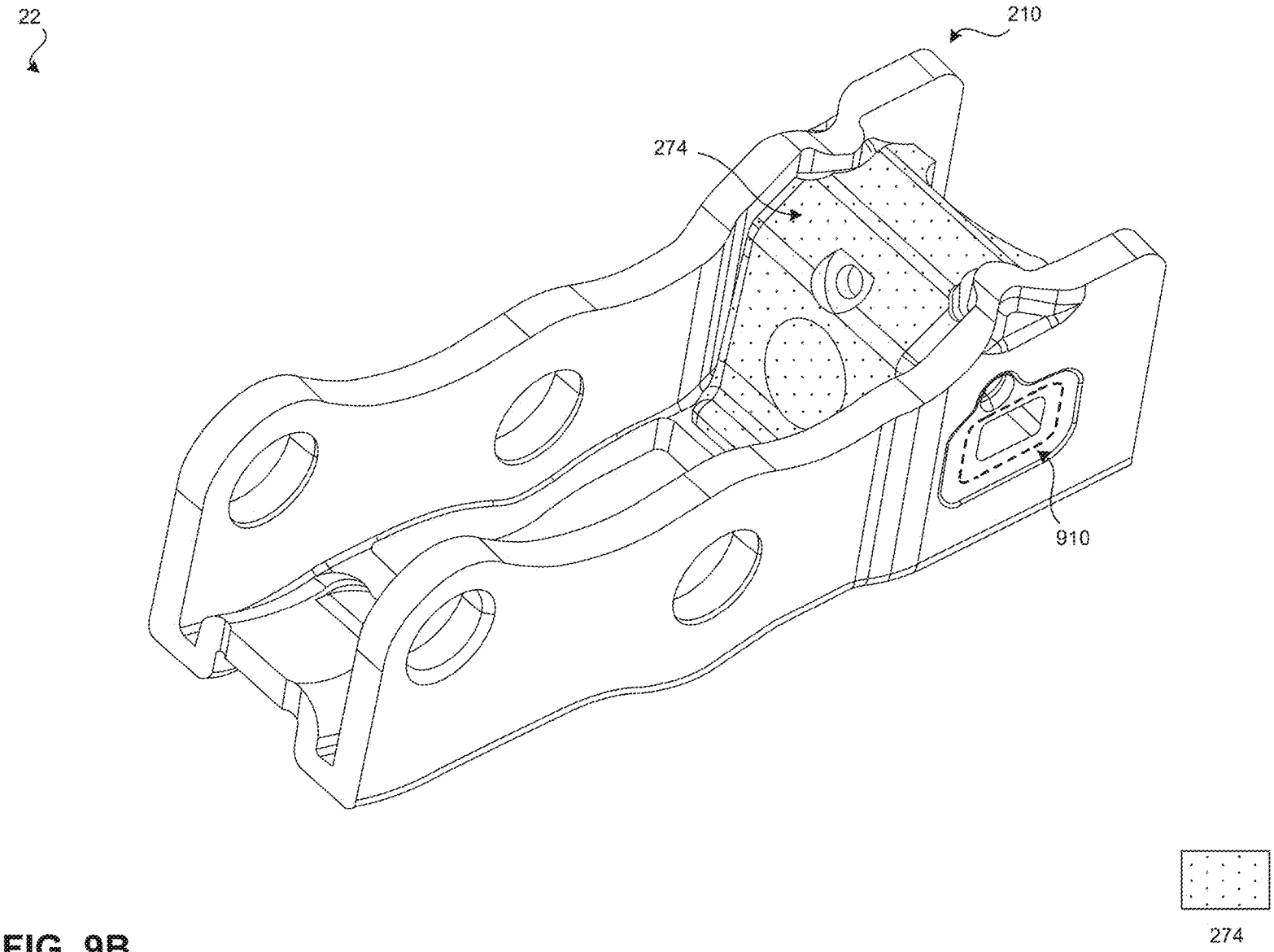
FIG. 9B illustrates a schematic perspective view of a rocker arm assembly, with particular components removed for further illustrating a latching pin body assembly therein, according to particular embodiments.

FIG. 9B illustrates a schematic perspective view of a rocker arm assembly, with particular components removed for further illustrating a latching pin body assembly therein, according to particular embodiments. Latching pin body 274, as may be initially provided separately and placed in position for coupling, such as by welding, is highlighted for clarity using a dot pattern, as indicated by the legend.

Figure 9C:
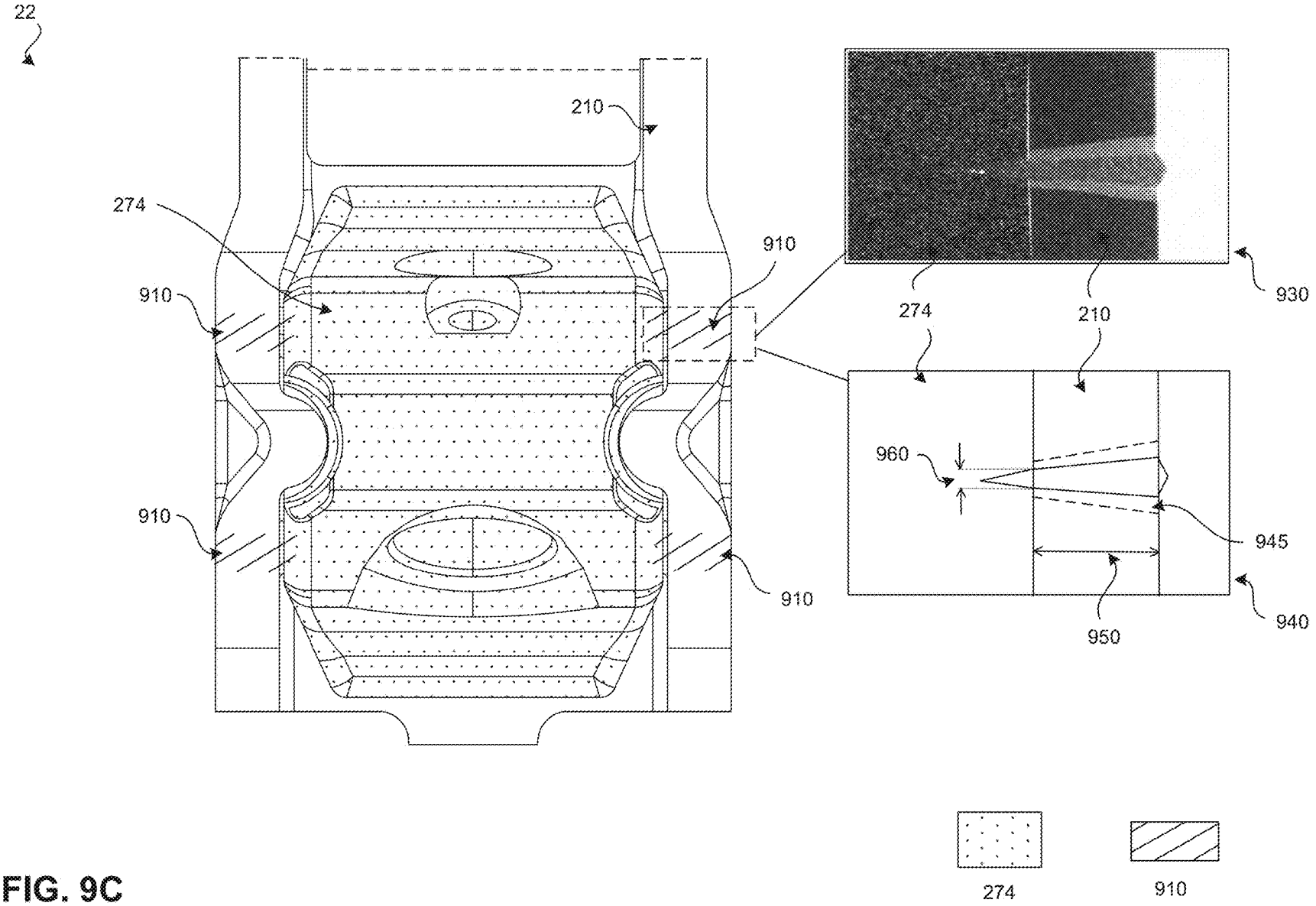
FIG. 9C illustrates a schematic top view of a rocker arm assembly, with particular components removed for further illustrating a latching pin body assembly therein, according to particular embodiments. Particular insets illustrate a partial enlarged cross-sectional photographic view and a corresponding partial enlarged schematic representation of welding assembly aspects, according to particular embodiments.

FIG. 9C illustrates a schematic top view of a rocker arm assembly, with particular components removed for further illustrating a latching pin body assembly therein, according to particular embodiments. Particular cross-sectional zones or seams for welding path or location 910 are highlighted by hatching, as indicated by the legend. As discussed above, inset 930 provides a partial enlarged cross-sectional photographic view of an overlap welding joint, as illustrated; inset 940 provides a corresponding partial enlarged schematic representation of these overlap welding aspects, according to particular embodiments. By way of example and not limitation, the joint indicates a large weld seam on and passing through outer body 210 (right to left, in the frame of reference of inset 930 and 940), into a thin section of latching pin body 274. A large heat affected zone 945 is illustrated. By way of example and not limitation, a thickness 950 of a first material layer, such as outer body 210, may be 3 mm. By way of example and not limitation, a width 960 of a weld line at the interface of two materials layers, such as outer body 210 and latching pin body 274, may be less than 0.5 mm.

Figure 9D:
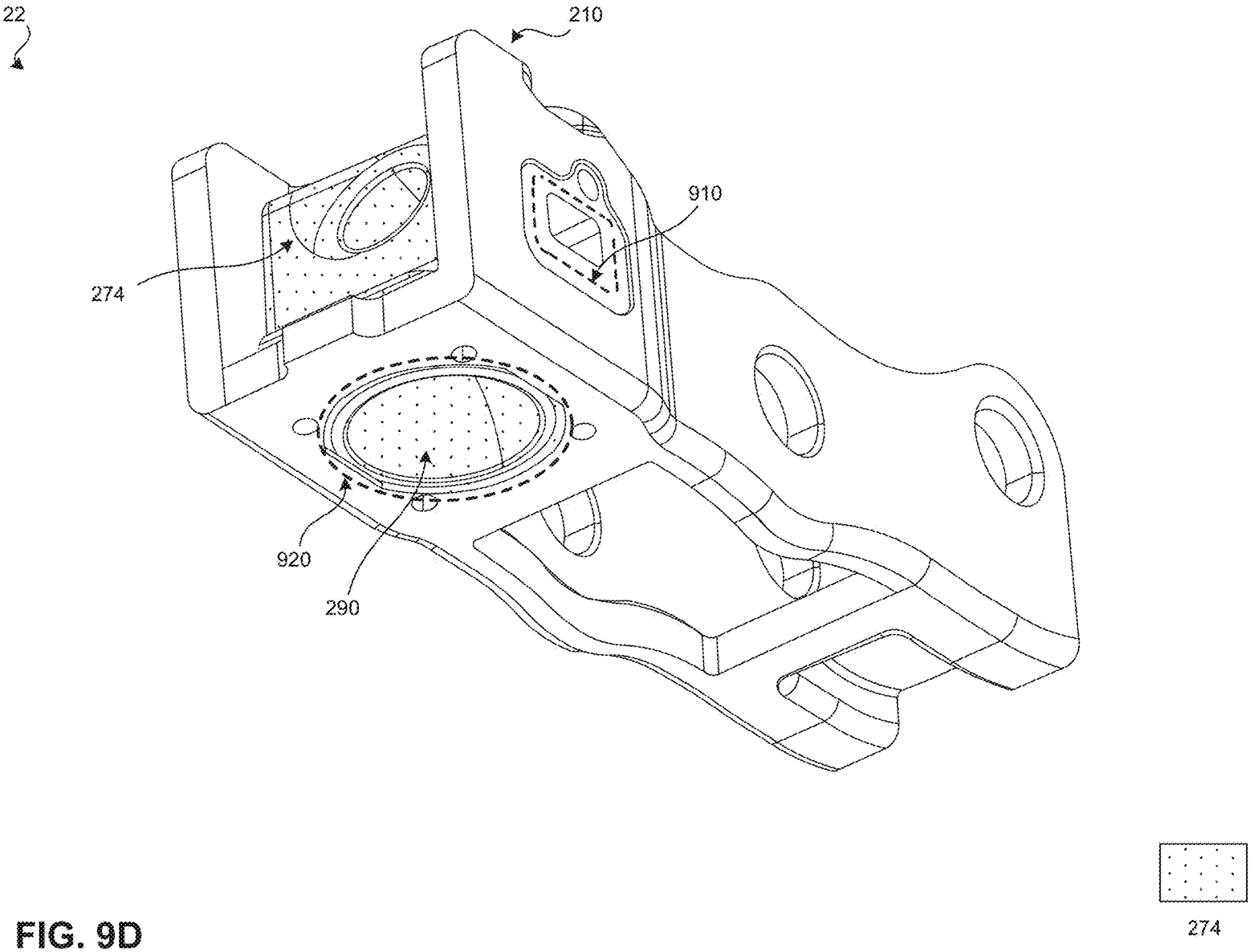
FIG. 9D illustrates a schematic perspective view of a rocker arm assembly, with particular components removed for further illustrating a latching pin body assembly therein, according to particular embodiments.

FIG. 9D illustrates a schematic perspective view of a rocker arm assembly, with particular components removed for further illustrating a latching pin body assembly therein, according to particular embodiments.

As may be appreciated, welding along location or path 910, such as by overlap welding as described, may present significant challenges. By way of example and not limitation, extremely precise and close contact between two surfaces to be welded by overlap welding is required. Unlike the figures provided herein for illustration, which may be based on schematically idealized drawings, actual production parts and their tolerances may provide substantial challenges for obtaining such precise and close contact for acceptable welds. Further, based on weld path or location 910 being provided on at least two sides of rocker arm assembly 22, a correspondingly long cycle or process time may be needed, such as for welding one side, repositioning the assembly and/or beam, and welding the other side.

Additionally, it can be appreciated from previous descriptions provided herein that particular embodiments of rocker arm assemblies 22 may not have locations such as weld path 910 available for welding or other coupling process. By way of example and not limitation, for particular embodiments such as illustrated in FIGS. 8A and/or 10A, packaging other large, required features such as rocker arm boss 285 may consume much of the available surfaces or spaces corresponding to weld path 910 for interfacing or welding latching pin body 274 with outer body 210. Additionally, a radiusing or curvature of rocker boss 285 (see, for e.g., FIG. 10A) near the base surface of outer body 210 introduces further constraints toward precision distances, gaps, and/or flatness requirements for attempting overlap welding along weld path 910.

FIG. 9D illustrates a weld or coupling path 920 as an alternative to weld path 910. In particular embodiments, a laser welding operation may be used to weld together latching pin body 274 and outer body 210 along weld path 920. In particular embodiments, a welding operation along weld path 920 may comprise butt welding, wherein correspondingly abutting edges of latching pin body 274 and outer body 210 may be welded without having to traverse through the full thickness of either material layer to obtain welding access to the other. In particular embodiments, a welding operation along weld path 920 may be completed as a single welding step based on a single side or location, i.e., without requiring realignment for performing welding at a different location subsequent to the first. In particular embodiments, a welding operation along weld path 920 may be performed around a circle, and/or exceeding a circular traversal to assure integrity of the full weld path 920.

In particular embodiments, a welding operation along weld path 920 may be performed around other closed or open trajectories, such as a racetrack shape, and/or a trajectory combining parts of circles, other curvilinear shapes, and/or one or more flattened or linear aspects. In particular embodiments, a welding operation along weld path 920 may be performed around an oval, elliptical, and/or other curvilinear shape. By way of example and not limitation, a butt weld may be provided by a laser welding operation, traversing somewhat greater than a full 360° circular path, such as by traversing 390°. In particular embodiments, the welding connection may be applied as a single, continuous pass, which may provide benefits of reduced process cycle time and/or weld integrity. In particular embodiments, the welding connection may be applied in multiple segments and/or passes, or otherwise discontinuously.

In particular embodiments, a butt-welding operation can enable a higher quality and more well-controlled weld beam, resulting in a cleaner and stronger weld. By way of example and not limitation, overlap welding around weld path 910 may require delivery of substantial energy and/or heat for overcoming a first material layer, which may create challenges based on larger undesired deformations, heat affected zones, and lower ability to control and create precise, highly localized welds, as opposed to butt welding around weld path 920.

FIGS. 10A-10D illustrate particular aspects of a rocker arm assembly, particular illustrating a latching pin body assembly therein, and/or coupling thereof, according to particular embodiments.

Figure 10A:
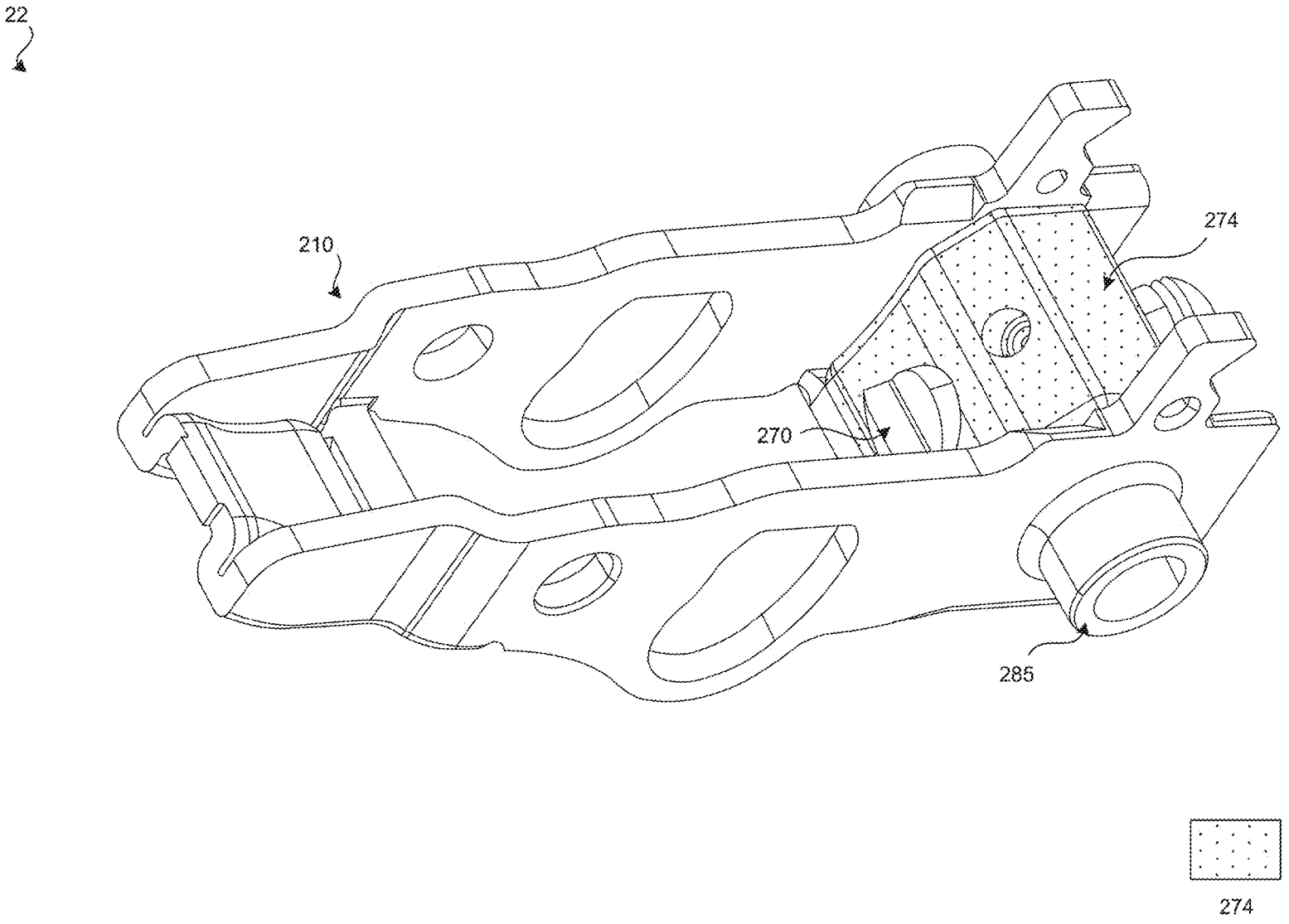
FIG. 10A illustrates a schematic perspective view of a rocker arm assembly, with particular components removed for further illustrating a latching pin body assembly therein, according to particular embodiments.
Figure 10B:
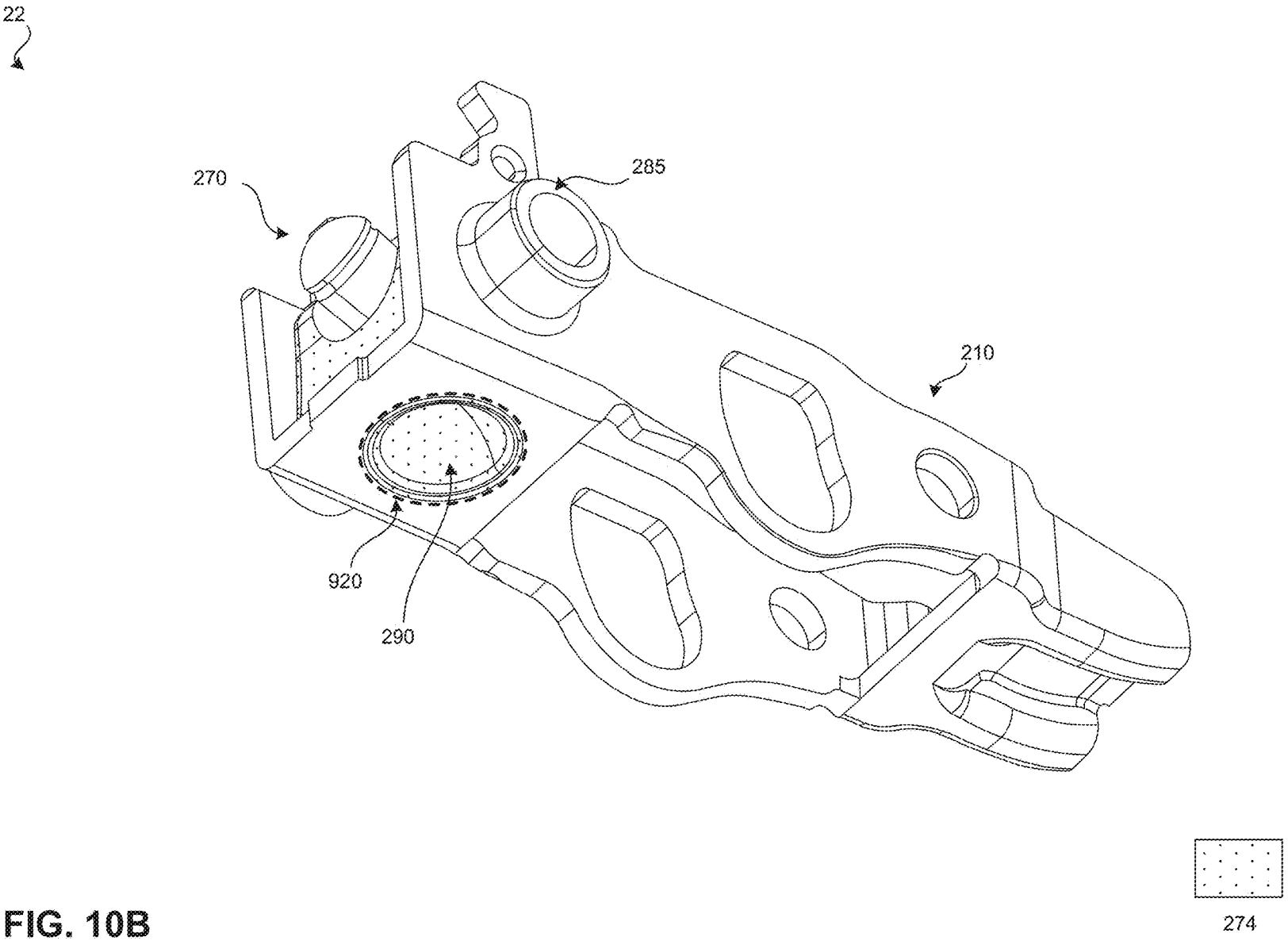
FIG. 10B illustrates a schematic perspective view of a rocker arm assembly, with particular components removed for further illustrating a latching pin body assembly therein, according to particular embodiments.

FIG. 10A illustrates a schematic perspective view of a rocker arm assembly, with particular components removed for further illustrating a latching pin body assembly therein, according to particular embodiments. FIG. 10B illustrates a schematic perspective view of a rocker arm assembly, with particular components removed for further illustrating a latching pin body assembly therein, according to particular embodiments.

Figure 10C:
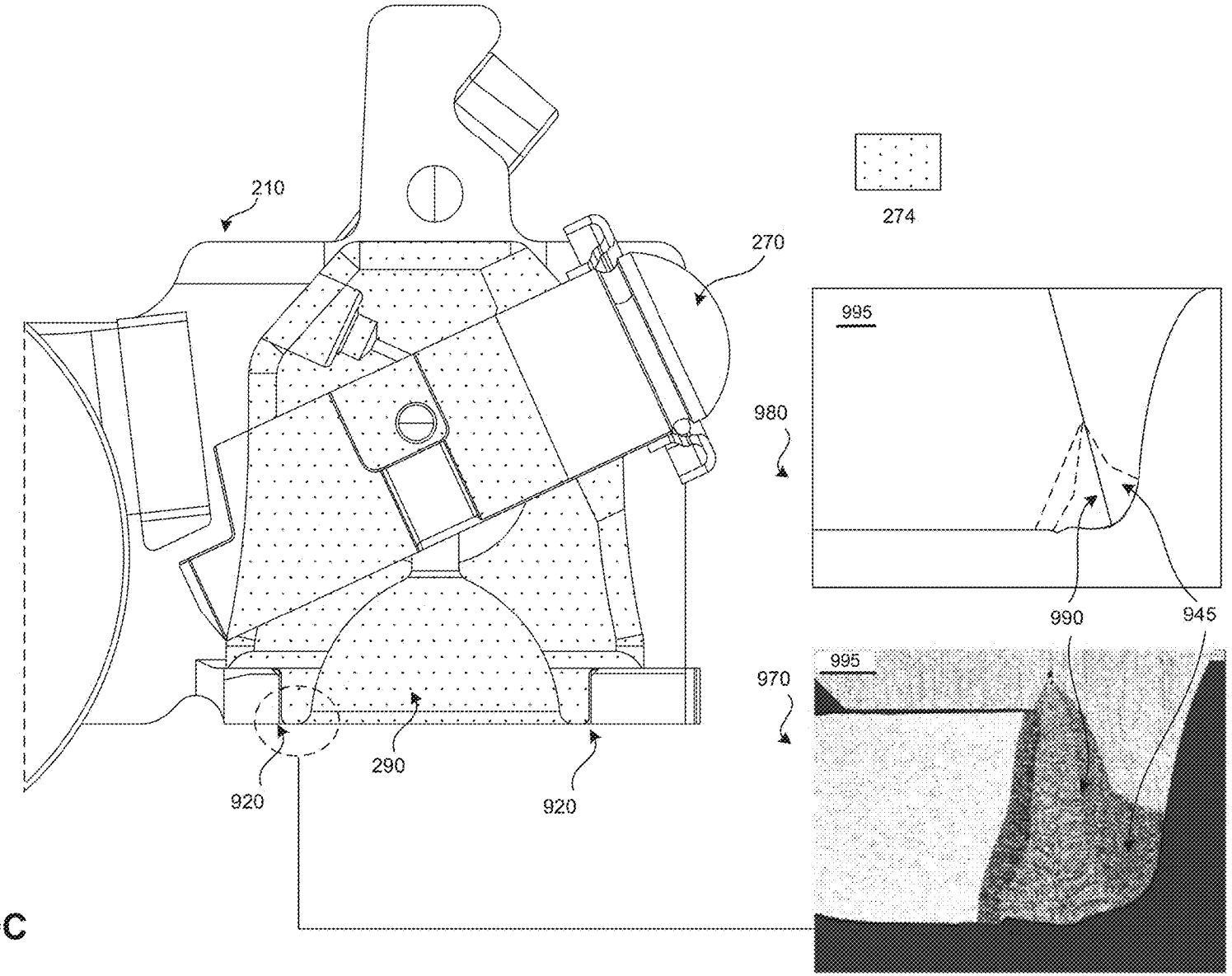
FIG. 10C illustrates a schematic side cross-sectional enlarged partial view of a rocker arm assembly, with particular components removed for further illustrating a latching pin body assembly therein, according to particular embodiments. Particular insets illustrate a partial enlarged cross-sectional photographic view and a corresponding partial enlarged schematic representation of welding assembly aspects, according to particular embodiments.

As discussed above, in particular embodiments of rocker arm assemblies 22, such as illustrated in FIGS. 10A-10C, packaging large, required features such as rocker arm boss 285 may consume much of the available surfaces or spaces corresponding to weld path 910. Thus, while weld path 920 may be fully and usefully employed in embodiments of rocker arm assembly 22 such as illustrated and described for FIGS. 9A-9D, the embodiments of FIGS. 10A-10C can benefit even more from weld path 920 based on the relative unavailability of suitable locations due to other features. As discussed, as a non-limiting example, weld path 920 may be followed in or by a laser welding operation performing butt welding between latching pin body 274 and outer body 210.

FIG. 10C illustrates a schematic side cross-sectional enlarged partial view of a rocker arm assembly, with particular components removed for further illustrating a latching pin body assembly therein, according to particular embodiments. Particular cross-sectional zones or seams for welding path or location 920 are indicated. Inset 970 provides a partial enlarged cross-sectional photographic view of a butt-welding joint at 920, as illustrated; inset 980 provides a corresponding partial enlarged schematic representation of these butt-welding aspects at 920, according to particular embodiments. By way of example and not limitation, the joint indicates a weld seam 990, and heat affected zone 945, as illustrated. By way of example and not limitation, a length scale 995 for providing context for insets 980 and/or 990 may be 500 μm, as a non-limiting example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

Numerical ranges recited in this application should be construed to be inclusive of the end points of the stated ranges. Particular axes, such as one or more lateral and/or longitudinal axes, which may be omitted herein in some illustrations, should be construed to exist in every illustration or situation where it is referred to.

What is claimed:

1. An actuation mechanism for selective switching of a valvetrain switching mechanism by a linear actuator mechanism, the actuation mechanism comprising:

an actuator arm comprising a first end and a second end opposite the first end, the second end of the actuator arm comprising a pin contact surface configured to cooperatively engage with a selectively and linearly extendable actuator pin of the actuator mechanism;

a switching arm comprising a first end and a second end opposite the first end; and a lever axle pivotally coupling the actuator arm and the switching arm at the first end of each of the actuator arm and the switching arm, the lever axle rotatable about a lever axis;

wherein the actuation mechanism is configured to:

rotate about the lever axis in a first direction based on an extension of the actuator pin along an axis of linear motion of the actuator pin, and rotate about the lever axis in a second direction opposite to the first direction based on a retraction of the actuator pin along the axis of linear motion of the actuator pin;

wherein the second end of the switching arm is configured to selectively act on a switching element of the valvetrain switching mechanism based on the rotation of the actuation mechanism; and wherein, based on the rotation of the actuation mechanism about the lever axis, a plurality of interface positions disposed on the pin contact surface of the actuator arm are each configured to cooperatively engage with the actuator pin at an orthogonal angle to the axis of linear motion of the actuator pin.

2. The actuation mechanism of claim 1, wherein the pin contact surface comprises a curved surface having a curvature along a contact trajectory of the pin contact surface with the actuator pin, the plurality of interface positions disposed along the contact trajectory.

3. The actuation mechanism of claim 1, further comprising one or more second switching arms, each second switching arm comprising a first end and a second end, wherein the lever axle further pivotally couples the respective first end of each second switching arm to be rotatable about the lever axis, and wherein the respective second end of each second switching arm is configured to selectively act on a respective second switching element of the valvetrain switching mechanism based on the rotation of the actuation mechanism.

4. The actuation mechanism of claim 1, further comprising a biasing member configured to bias rotation of the actuation mechanism in the first direction or the second direction.

5. The actuation mechanism of claim 1, further comprising a supporting member coaxially provided with the lever axle and configured to secure the actuation mechanism to an external structure.

6. The actuation mechanism of claim 5, further comprising an over-travel limiter coaxially provided with the lever axle and rotatably coupled with the lever axle, the over-travel limiter structured to constrain a rotational travel limit of the switching arm.

7. An actuation system for a switchable valvetrain assembly, the actuation system comprising:

a linear actuator comprising a selectively extendable actuator pin;

a rocker arm of the switchable valvetrain assembly, the rocker arm further comprising a switchable latching pin; and an actuation mechanism comprising:

an actuator arm comprising a first end and a second end opposite the first end, the second end of the actuator arm comprising a pin contact surface configured to cooperatively engage with the actuator pin;

a switching arm comprising a first end and a second end opposite the first end; and a lever axle pivotally coupling the actuator arm and the switching arm at the first end of each of the actuator arm and the switching arm, the lever axle rotatable about a lever axis;

wherein the actuation mechanism is configured to rotate about the lever axis between a first lever position and a second lever position based on a selective extension of the actuator pin along an axis of linear motion of the actuator pin;

wherein the second end of the switching arm is configured to selectively switch the switchable latching pin of the rocker arm based on the position of the actuation mechanism; and wherein, based on the rotation of the actuation mechanism about the lever axis, a plurality of interface positions disposed on the pin contact surface of the actuator arm are each configured to cooperatively engage with the actuator pin at an orthogonal angle to the axis of linear motion of the actuator pin.

8. The actuation system of claim 7, wherein the pin contact surface comprises a curved surface having a curvature along a contact trajectory of the pin contact surface with the actuator pin, the plurality of interface positions disposed along the contact trajectory.

9. The actuation system of claim 7, further comprising one or more second switching arms, each second switching arm comprising a first end and a second end, wherein the lever axle further pivotally couples the respective first end of each second switching arm to be rotatable about the lever axis, and wherein the respective second end of each second switching arm is configured to selectively switch a respective second switchable latching pin based on the rotation of the actuation mechanism.

10. The actuation system of claim 7, further comprising a biasing member configured to bias rotation of the actuation mechanism toward the first lever position or the second lever position.

11. The actuation system of claim 7, further comprising a supporting member coaxially provided with the lever axle and configured to secure the actuation mechanism to an external structure.

12. The actuation system of claim 11, further comprising an over-travel limiter coaxially provided with the lever axle and rotatably coupled with the lever axle, the over-travel limiter structured to constrain a rotational travel limit of the switching arm based on the over-travel limiter selectively contacting the supporting member to prevent rotation of the switching arm.

13. The actuation system of claim 10, wherein an actuator arm distance and a switching arm distance are configured based on at least a force rating and a stroke length rating of the actuator pin, such that the actuator pin is enabled to selectively act on the actuation mechanism and correspondingly selectively switch the switchable latching pin of the rocker arm;

wherein the actuator arm distance is defined as a shortest distance between the axis of linear motion of the actuator pin and the lever axis, and wherein a switching arm distance is defined as a shortest distance between a longitudinal axis of the switchable latching pin and the lever axis.

14. The actuation system of claim 13, wherein the actuator arm distance and the switching arm distance are configured further based on one or more latching pin parameters of the switchable latching pin.

15. The actuation system of claim 14, wherein a biasing member of the actuation mechanism is configured based on at least the actuator arm distance and the switching arm distance of the actuation mechanism.

16. A method of selectively switching a latching pin of a rocker arm by a linear actuator mechanism, the method comprising:

selectively extending an actuator pin of the actuator mechanism between a first actuator pin position and a second actuator pin position along an axis of linear motion, the actuator pin engaging a pin contact surface of an actuation mechanism, the actuation mechanism comprising an actuator arm and a switching arm, the pin contact surface provided at an end of the actuator arm;

operating, based on selectively extending the actuator pin, the actuator arm to selectively rotate the actuation mechanism about a lever axis between a first lever position and a second lever position; and operating, based on selectively rotating the actuation mechanism and based on pivotal coupling of the actuator arm and a switching arm by a lever axle of the actuation mechanism, the switching arm to selectively act on the latching pin of the rocker arm, wherein, based on the rotation of the actuation mechanism between the first and second lever positions, a plurality of interface positions disposed on the pin contact surface are each configured to cooperatively engage with the actuator pin at an orthogonal angle to the axis of linear motion of the actuator pin.

17. The method of claim 16, wherein the pin contact surface comprises a curved surface having a curvature along a contact trajectory of the pin contact surface with the actuator pin, the plurality of interface positions disposed along the contact trajectory.

18. The method of claim 16, the method further comprising configuring an actuator arm distance and a switching arm distance based on at least a force rating and a stroke length rating of the actuator pin, such that the actuator pin is enabled to selectively act on the actuation mechanism and correspondingly selectively switch the latching pin of the rocker arm, wherein the actuator arm distance is defined as a shortest distance between the axis of linear motion of the actuator pin and the lever axis of the actuation mechanism, and wherein a switching arm distance is defined as a shortest distance between a longitudinal axis of the latching pin and the lever axis.

* * * * *